US005952977A

United States Patent [19]

Taniguchi et al.

[11] Patent Number: 5,952,977

[45] **Date of Patent: *Sep. 14, 1999**

[54] GLASS ANTENNA

[75] Inventors: Tatsuaki Taniguchi; Kazuo Shigeta, both of Hiroshima-ken; Kenji Kubota, Kure, all of Japan

[73] Assignee: Mazda Motor Corporation, Hiroshima, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/556,754

[22] Filed: Nov. 2, 1995

[30] Foreign Application Priority Data

Nov. 4, 1994 [JP] Japan ..... 6-271005
Nov. 4, 1994 [JP] Japan ..... 6-271006

[51] Int. Cl.[6] ..... H01Q 1/32
[52] U.S. Cl. ..... 343/713; 343/704
[58] Field of Search ..... 343/704, 713; H01Q 1/32, 1/38

[56] References Cited

U.S. PATENT DOCUMENTS 5,029,308 7/1991 Lindenmeier et al. ..... 343/704
5,097,270 3/1992 Lindenmeier et al. ..... 343/704
5,099,250 3/1992 Paulus et al. ..... 343/704

FOREIGN PATENT DOCUMENTS 55-60304 5/1980 Japan .
62-131606 6/1987 Japan .
63-92409 6/1988 Japan .

*Primary Examiner*—Michael C. Wimer

[57] ABSTRACT

A glass antenna system with good rear visibility. A glass antenna has a first antenna conductor element extending on a blank region where no defogger hot wires extend, a second antenna conductor element which is capacitively coupled to the first antenna conductor element in a defogger region, a third antenna conductor element which extends at a position substantially symmetrical to the first antenna conductor element about the central line of the defogger, and a fourth antenna conductor element which extends at a position substantially symmetrical to the second antenna conductor element about the central line, and is capacitively coupled to the third antenna conductor element.

28 Claims, 25 Drawing Sheets

FIG. 7

| COUPLING CAPACITANCE | SHORTENING RATIO |
|---|---|
| 5 pF | 0.7 |
| 8 pF | 0.68 |
| 10 pF | 0.75 |
| 15 pF | 0.84 |
| 25 pF | 0.95 |
| 40 pF | 1.0 |

GLASS ANTENNA

BACKGROUND OF THE INVENTION

The present invention relates to a glass antenna disposed on a window glass for, e.g., a vehicle and, more specifically, to a glass antenna having two antenna conductor wire elements which are arranged in a defogger and are capacitively coupled to each other.

In general, as an antenna for a vehicle, a pole antenna, which is constituted by a pole (rod) projecting on the body of the vehicle in an insulating state, and feeds electric power to the pole, is popular. However, this pole antenna is easily bent or damaged, and generates wind noise upon travelling. For these reasons, a glass antenna has been put into a practical application in place of the pole antenna.

As disclosed in, e.g., Japanese Utility Model Laid-Open No. 63-92409, the glass antenna has an antenna wire disposed in the vicinity of a defogger arranged in a window glass of a vehicle, and feeds electric power to the wire.

However, in the conventional glass antenna, the reception performance of the antenna is tuned by disposing the antenna wire in the vicinity of the defogger, and an established method of improving the performance of the antenna is not available. Therefore, systematic tuning is not possible, and it is difficult to predict the tuning result. In addition, the arrangement of the antenna itself becomes complicated.

On the other hand, as disclosed in Japanese Patent Laid-Open No. 62-131606, another antenna system has been proposed. In this system, a transparent conductive film is formed on a glass surface, an antenna body having a feed point is disposed on the glass surface above the conductive film, and the antenna body is capacitively coupled to the transparent conductive film.

Also, in U.S. Pat. No. 5,029,308, a first antenna conductor wire is arranged in a region where defogger hot wires extend, and extends in the up-and-down direction at substantially the center of a defogger region, so that the first antenna conductor wire and the hot wires crossing the conductor wire are electrically connected to each other. Furthermore, a second antenna conductor wire is arranged on an upper region (or lower region) of the defogger to be connected to the uppermost (or lowermost) hot wire of the defogger. More specifically, the first and second antenna conductor wires serve as a single antenna. However, when the first and second antenna conductor wires are connected to each other, a DC current flowing through the defogger is shunted to the first antenna conductor wire, and the defogging effect is impaired near the connection points.

In view of this problem, in U.S. Pat. No. 5,029,308, a capacitor is arranged between the first and second antenna conductor wires, so that the current flowing through the defogger is not shunted. Note that the capacitance (or capacity) of this capacitor is selected to have a value, which does not have a high impedance with respect to the reception frequency band since the first and second antenna conductor wires must serve as a single antenna.

Furthermore, in an antenna system disclosed in Japanese Patent Laid-Open No. 55-60304, a first antenna conductor wire is arranged in the up-and-down direction in a defogger region, and a second antenna conductor wire is arranged outside the defogger region. A first conductive wire which is connected to the first antenna conductor wire and extends in a direction perpendicular to the first antenna conductor wire (e.g., parallel to defogger hot wires), and a second conductive wire connected to the second antenna conductor wire are arranged close to each other on a glass surface so as to be capacitively coupled to each other.

In the above-mentioned prior arts (Japanese Utility Model Laid-Open No. 63-92409 and Japanese Patent Laid-Open No. 62-131606), although the antenna body is capacitively coupled to the transparent conductive film, if a thin film is used to assure transparency of the conductive film, its electrical resistance value inevitably becomes very high, and a reception current becomes hard to flow. As a result, satisfactory antenna performance cannot be expected in a practical use.

In U.S. Pat. No. 5,029,308, since the capacitor is selected to have a low impedance in the frequency band of received radio waves, the defogger hot wires serve as an antenna, and hence, a heating current flowing through the hot wires influences the antenna, resulting in deteriorated antenna performance.

Also, in Japanese Patent Laid-Open No. 55-60304, since the shape of the antenna arranged outside the defogger region is not taken into consideration, in other words, since a measure for preventing the defogger hot wires from serving as an antenna is not taken, the antenna performance deteriorates as in U.S. Pat. No. 5,029,308.

As described above, with the conventional glass antenna, in order to minimize deterioration of the antenna performance and to prevent the defogger current from flowing through the antenna conductor wires, the antenna conductor wires are arranged at the center of the defogger, i.e., at the center of the glass. For this reason, the field of view is disturbed at near the center of the glass (in particular, near the center where the defogger hot wires extend), resulting in poor visibility.

Since the conventional glass antenna is arranged under the condition that some of antenna conductor wire elements are arranged on a region without the defogger, i.e., since the antenna conductor wire elements require a blank region without defogger hot wires, the defogging function is impaired in such a blank region, and rear visibility similarly deteriorates.

SUMMARY OF THE INVENTION

The present invention has been made in consideration of the above situation, and has as its object to provide a glass antenna with satisfactory rear visibility.

In order to achieve the above object, according to the present invention, a glass antenna arranged on a glass which has a defogger region where a plurality of hot wires extend as a defogger in the widthwise direction of a vehicle body, and a blank region where no hot wires extend, comprises:

- a first antenna conductor wire element extending on the blank region;
- a second antenna conductor wire element which extends in the up-and-down direction on the glass while being electrically directly connected to the hot wires of the defogger in the defogger region, and is capacitively coupled to the first antenna conductor wire element;
- a third antenna conductor wire element which extends in the blank region at a position substantially symmetrical to the first antenna conductor wire element about the central line of the defogger; and
- a fourth antenna conductor wire element which extends in the defogger region at a position substantially symmetrical to the second antenna conductor wire element about the central line, and is capacitively coupled to the third antenna conductor wire element.

With the above arrangement, high rear visibility is assured since a blank region remains at the center of the glass. The first and second antenna conductor wire elements serve as a single antenna, and the third and fourth antenna conductor wire elements serve as a single antenna. The glass antenna with good performance can be provided since the coupling capacitance between the first and second antenna conductor wire elements and the coupling capacitance between the third and fourth antenna conductor wire elements are set to be equal to or smaller than a predetermined value.

In order to achieve the above object, according to the present invention, a glass antenna arranged on a glass which has a defogger region where a plurality of hot wires extend as a defogger in the widthwise direction of a vehicle body, and a blank region where no hot wires extend, comprises:

a first antenna conductor element (171) extending on the blank region;

a second antenna conductor element (172L) which extends in the up-and-down direction on the glass while being electrically directly connected to the hot wires of the defogger in the defogger region, and is capacitively coupled to the first antenna conductor element; and a third antenna conductor element (172R) which extends in the defogger region at a position substantially symmetrical to the second antenna conductor element (172L) about the central line of the glass, and is capacitively coupled to the first antenna conductor element (171), wherein a coupling capacitance between the first and second antenna conductor elements and a coupling capacitance between the first and third antenna conductor elements are set to be equal to or smaller than a predetermined value.

According to this glass antenna, since no antenna conductor wire elements are arranged in the defogger region, a satisfactory rear view can be assured. Furthermore, since the coupling capacitance between the first and second antenna conductor wire elements and the coupling capacitance between the first and third antenna conductor wire elements are set to be equal to or smaller than predetermined values, the first and second antenna conductor wire elements serve as one antenna, and the first and third antenna conductor wire elements serve as another antenna.

In order to achieve the above object, according to the present invention, a glass antenna arranged on a glass on which a plurality of hot wires extend as a defogger (250) in the widthwise direction of a vehicle body, comprises:

a first antenna conductor element (180, 190L) which extends in a glass range, where the defogger is arranged, in substantially the up-and-down direction while crossing at least one of the host wires of the defogger; and a second antenna conductor element (183, 192L) which is capacitively coupled to the first antenna conductor element, and extends on a surface of the glass in substantially the up-and-down direction in a region of the defogger.

According to this glass antenna, the first and second antenna conductor wire elements serve as a single antenna since they are capacitively coupled. Since both the first and second antenna conductor wire elements extend within the defogger region, the defogging function can be maintained, and hence, a sufficient rear view can be assured.

According to a preferred aspect of the present invention, the first and third antenna conductor wire elements have a loop shape. Therefore, a glass antenna with good reception performance can be provided.

According to a preferred aspect of the present invention, another antenna conductor element is arranged on a blank region between the first and third antenna conductor wire elements. With this arrangement, the blank region can be effectively utilized.

According to a preferred aspect of the present invention, the first antenna conductor wire element is arranged at substantially the center.

The glass antenna according to a preferred aspect of the present invention, further comprises:

a third antenna conductor wire element which crosses at least one of the hot wires of the defogger and extends in the region of the defogger in substantially the up-and-down direction; and a fourth antenna conductor wire element which is capacitively coupled to the third antenna conductor wire element, and extends on the glass surface in substantially the up-and-down direction in the region of the defogger, wherein the first antenna conductor wire element is disposed at a position substantially symmetrical to the third antenna conductor wire element about the central line, in the widthwise direction of the vehicle body, of the defogger, and the second antenna conductor wire element is disposed at a position substantially symmetrical to the fourth antenna conductor wire element about the central line.

According to the above-mentioned glass antenna, since the third and fourth antenna conductor wire elements serve as another antenna, a diversity antenna system can be constituted. In addition, since the first antenna conductor wire element is disposed at a the position substantially symmetrical to the third antenna conductor wire element about the central line, in the widthwise direction of the vehicle, of the defogger, and the second antenna conductor wire element is disposed at the position substantially symmetrical to the fourth antenna conductor wire element about the central line, no antenna conductor wire elements are present at the central portion of the defogger, thus assuring rear visibility.

According to a preferred aspect of the present invention, since both the first and second antenna conductor wire elements are disposed at substantially the central position, in the widthwise direction of the vehicle, of the defogger, uniform directivity can be assured in the right-and-left direction.

According to the glass antenna of the preferred aspect of the present invention, since the second antenna conductor wire element is present on the extended line of the first antenna conductor wire element, i.e., since these two antenna conductor wire elements are aligned on a single line, the influence of defogger hot wires on the antenna performance can be further eliminated.

According to the glass antenna of the preferred aspect of the present invention, one end of the first antenna conductor wire element forms a capacitance between the first and second outermost hot wires, in the up-and-down direction, of the defogger together with the second antenna conductor wire element. With this arrangement, the antenna performance can be optimized.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 7 is a table showing examples of the relationship between the shortening ratio a and the coupling capacitance C;

DESCRIPTION OF THE PREFERRED EMBODIMENTS

The preferred embodiments of the present invention will be described hereinafter with reference to the accompanying drawings.

The structure of a rear window glass for a vehicle (FIGS. 1 and 2), which has a defogger, will be described first, and then, the principle of a capacitive coupling antenna as a basis of a glass antenna of the present invention will be described below with reference to FIGS. 3 to 10. A glass antenna which includes two or more reception antennas designed based on the principle will be described as examples with reference to FIGS. 11 and 12. Thereafter, glass antennas according to embodiments (first to fifth embodiments) of the present invention will be explained.

In the glass antenna of each of the first to third embodiments, since two antenna conductor wires are set at symmetrical positions, in the right-and-left direction, at the central portion of a rear window glass, a blank region is formed at the central portion of the glass, thus assuring a sufficient rear view. In the antenna system of each of the fifth and fourth embodiments, antenna conductor wires are surrounded by hot wires to assure sufficient defogging performance.

Note that a glass antenna for a vehicle in the following description is applied particularly to an antenna of a rear window glass. In the description of each embodiment, terms "left", "right", "upper", and "lower" respectively indicate the left, right, upper, and lower sides of a vehicle body.

<Structure of Glass Antenna with Defogger>

Figure 1:
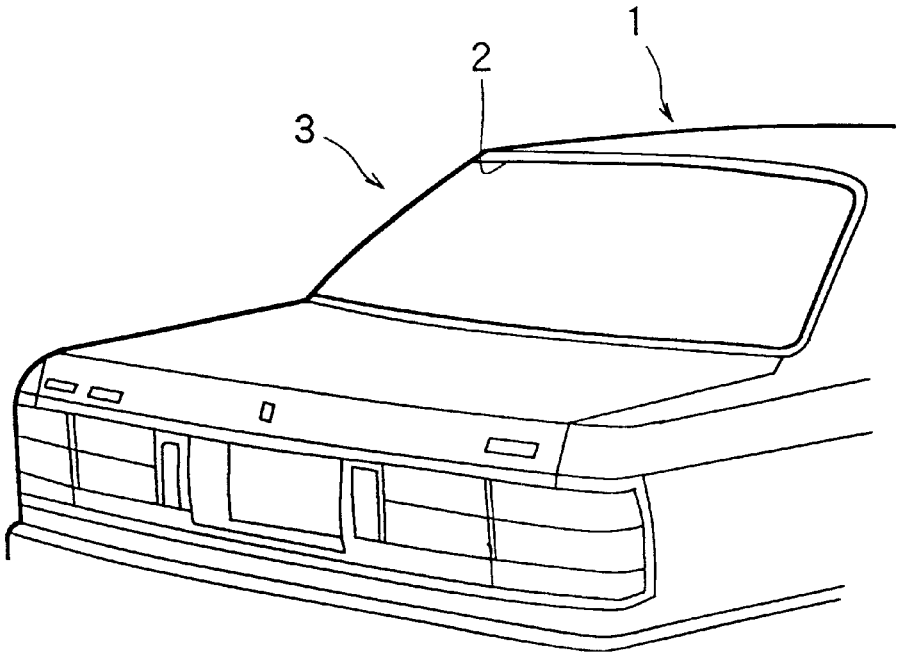
FIG. 1 is a perspective view showing the rear portion of a vehicle.

FIG. 1 shows the rear portion of a vehicle to which a glass antenna is applied in this specification. Reference numeral 1 denotes a vehicle body. A rear window 2 is open to the rear portion of the body 1, and a rear window glass 3 (to be simply referred to as a window glass hereinafter) is fitted in the rear window 2 in a substantially air-tight state.

Figure 2:
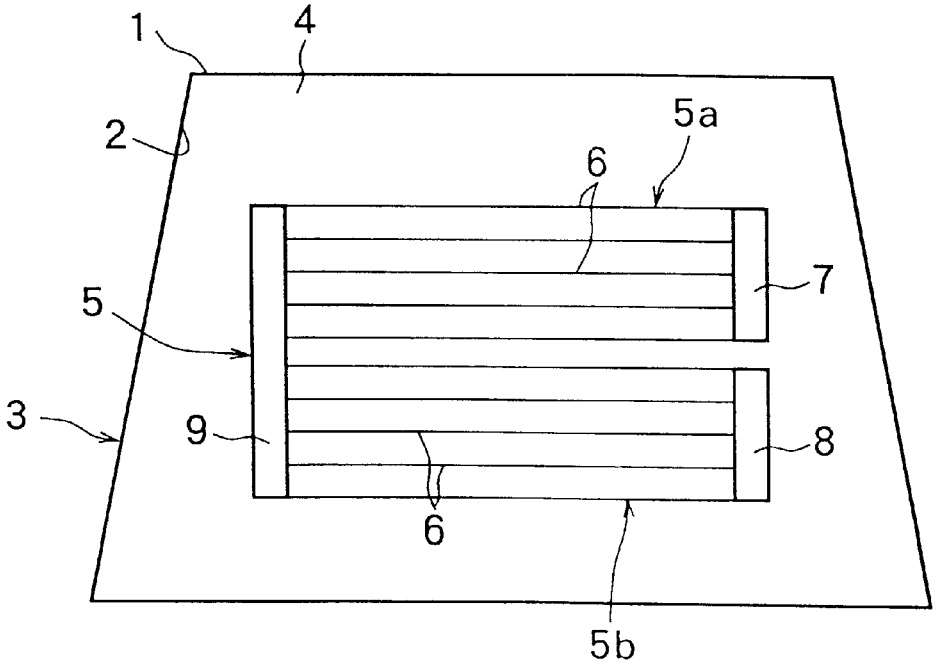
FIG. 2 is a plan view of a rear window glass of a vehicle, to which embodiments of the present invention are applied, in a direction perpendicular to the window glass surface.

As shown in FIG. 2, on the rear window glass 3 of the vehicle, a hot wire portion of a defogger 5 is disposed and attached so that the hot wire portion is separated by a blank portion 4 having a predetermined size from the upper end portion (the body 1 of the upper side of the surrounding portion of the window 2) of the window glass 3, and the central portion, in the right-and-left direction, of the defogger 5 substantially matches with that of the window glass 3. The defogger 5 has a U-shaped pattern having upper and lower portions 5*a* and 5*b*. More specifically, a plurality of heater wires (hot wires) 6 extending in the right-and-left direction (i.e., the widthwise direction of the vehicle) are divided into two, upper and lower portions, the end portions at one side (right side) of the upper and lower heater wires are respectively connected by two independent bus bars 7 and 8, and the end portions at the other end (left side) of the entire heater wires 6 are connected by a common bus bar 9.

Although not shown, the upper independent bus bar 7 is grounded to the body 1, and serves as the ground side of the defogger 5. On the other hand, the lower independent bus bar 8 is connected to the + power supply terminal of a vehicle mounted battery via a switch (not shown). When the switch is turned on, the battery supplies electric power to the heater wires 6 of the defogger 5 to generate heat, thereby defogging the surface of the window glass 3.

In this specification, an arrangement in which the end portions on the left side of the upper and lower heater wires 6 are connected by the independent bus bars 7 and 8, and the end portions on the right side of the entire heater wires 6 are connected by the common bus bar 9, i.e., a defogger having a pattern inverted to that described above in the right-and-left direction, is also called a "U" shape.

<Principle of Capacitive Coupling Antenna>

The defogger largely influences the performance of the glass antenna. In particular, since a DC current flowing through the defogger includes many noise components, it is preferable that the noise components be not superposed on the antenna. Furthermore, the hot wires of the defogger serve as antenna conductor wire elements, and it is difficult to design a glass antenna with a target performance.

A capacitive coupling antenna was proposed by the present inventors as Japanese Patent Application No. 6-205767 so as to remarkably improve the performance as compared to a conventional glass antenna. The capacitive coupling antenna is designed, so that the noise components from the defogger are cut off, and the defogger hot wires can be prevented from serving as antenna elements. The reason why the hot wires of the defogger can be prevented from influencing the operation of the antenna will be explained by describing the design method of a glass antenna proposed in Japanese Patent Application No. 6-205767 and the structure of a glass antenna constituted by the design method beforehand.

Figure 3:
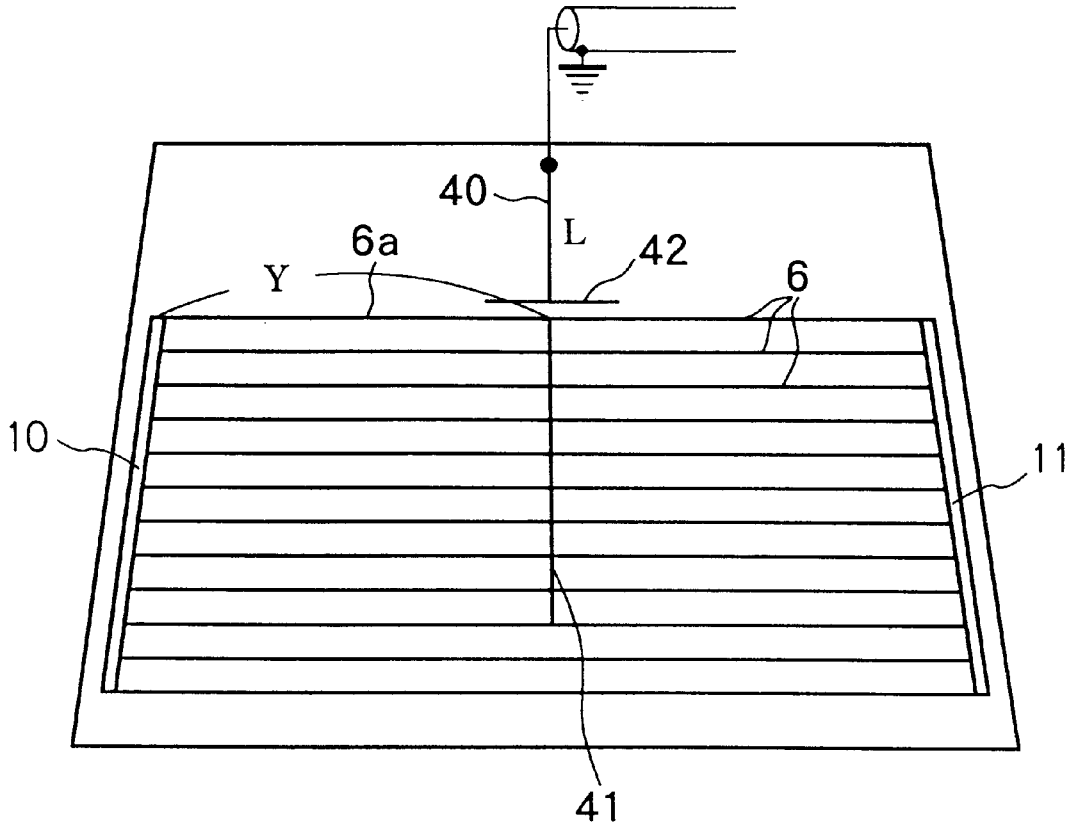
FIG. 3 is a view showing the basic arrangement of an antenna to explain the principle of minimizing the influence of a defogger.

FIG. 3 shows a state wherein a conductor wire 41 is arranged to cross the hot wires 6 in a hot wire region of the defogger. A conductor wire 42 is arranged to extend in a direction parallel to an uppermost hot wire 6*a*, and a conductor wire 40 is arranged to perpendicularly extend from the conductor wire 42. Let L be the length, from a feed point (in this specification, the feed point means only a portion substantially serving as a feed point), of the conductor wire 40, and 2Y be the length of the hot wire (uppermost hot wire 6*a*) of the defogger. Assume an equivalent circuit diagram shown in FIG. 4 to examine the relationship between the conductor wire 40 and the hot wires 6.

Figure 4:
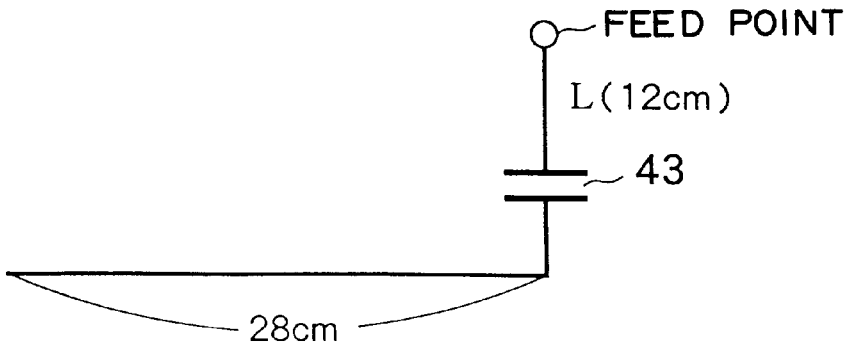
FIG. 4 is a view showing a model of the arrangement of the antenna to explain the principle of minimizing the influence of a defogger.
Figure 5:
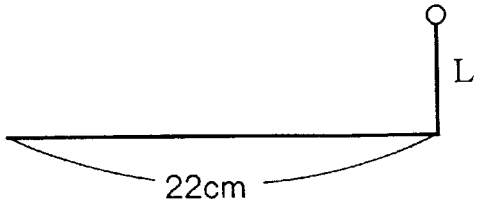
FIG. 5 is a view showing a model of the arrangement of the antenna to explain the principle of minimizing the influence of a defogger.

In FIG. 4, a capacitor 43 means a coupling capacitance formed by the conductor wire 42 and the hot wire 6*a*. Let $\alpha$ be the antenna shortening ratio by the capacitor 43. Assuming that the coupling capacitance C=11 pF (84 MHz), L=12 cm, and Y=28 cm, the antenna shown in FIG. 4 is equivalent to that shown in FIG. 5 due to the shortening effect of the capacitor 43. In this example, since the length from the position of the capacitor 43 to the end point of the antenna conductor wire is shortened from 28 cm to 22 cm, the capacitor shortening ratio $\alpha$ is:

$$\alpha=22/28$$

Figure 6:
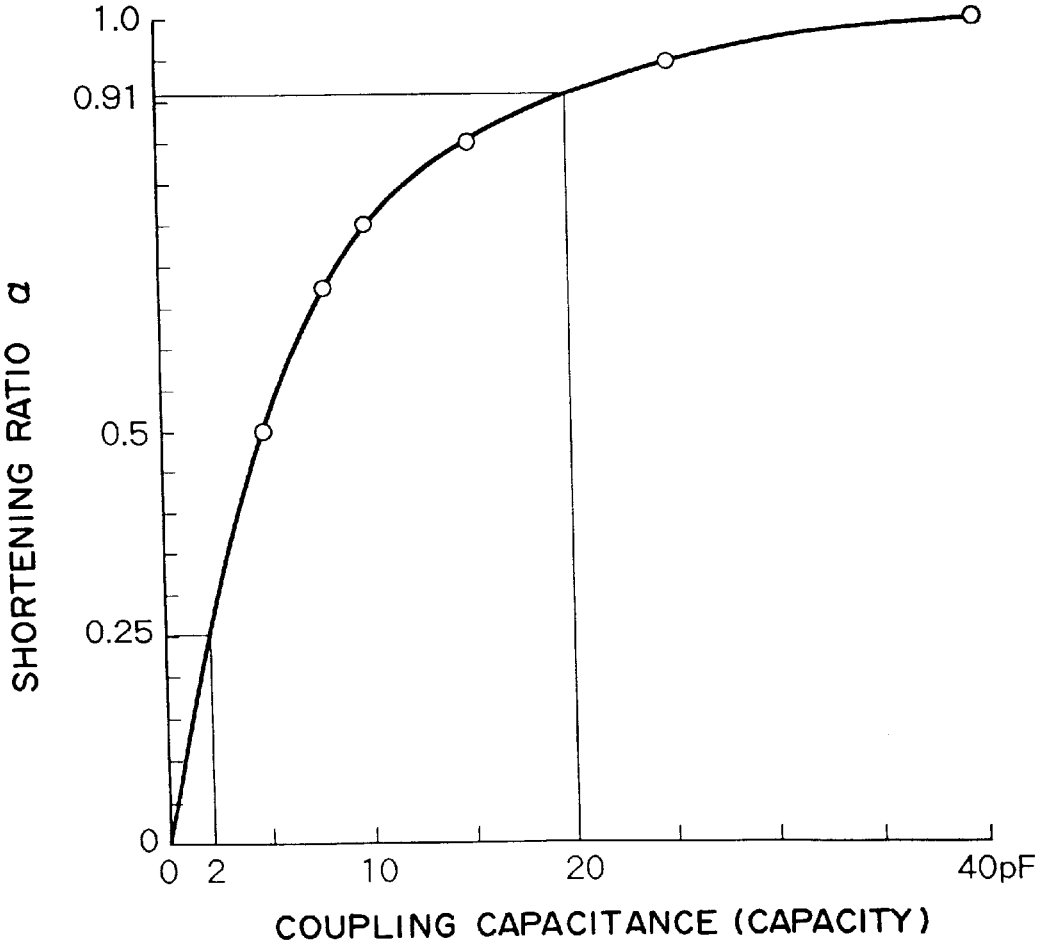
FIG. 6 is a graph showing the relationship between the shortening ratio, $\alpha$, and the coupling capacitance, C.

FIGS. 6 and 7 show the experimental results of the relationship between the shortening ratio $\alpha$ and the coupling capacitance. According to the graphs shown in FIGS. 6 and 7, the shortening ratio $\alpha$ increases as the coupling capacitance C increases. However, above 40 pF, the shortening ratio $\alpha$ does not exceed unity even when C continues to increase. This means that it is nonsense to increase the coupling capacitance beyond 40 pF.

In order to prevent the hot wire constituting the defogger, i.e., the hot wire 6*a* having the length 2Y from largely influencing the antenna performance, the hot wire 6*a* need only have a very large impedance. As a result of the experiments of the present inventors, it was found that to achieve this objective, it suffices to set the relationship among the length L of the conductor wire (a portion of the antenna), the length Y of the hot wire 6*a* (uppermost hot wire), and the shortening ratio $\alpha$ by capacitive coupling to satisfy:

$$\beta\cdot\frac{\lambda}{4}=L+\alpha\cdot Y \tag{1}$$

where $\lambda$ is the wavelength of radio waves to be received, and $\beta$ is the antenna shortening ratio by glass. As is well known, glass for a vehicle normally has about $\beta$=0.6.

Equation (1) can be modified as:

$$\alpha=\frac{\beta\cdot\frac{\lambda}{4}-L}{Y} \tag{2}$$

A case will be examined below wherein antennas are designed for various vehicles using equation (2). As can be seen from equation (2), when L becomes large depending on the type of vehicle, a becomes small. Thus, in order to eliminate the influence of the defogger, the coupling capacitance C is decreased according to the graph in FIG. 6. On the other hand, as can also be seen from equation (2), since a becomes large in a vehicle with a small length Y, a large capacitance C is set.

If the wavelength of radio waves to be received is that in the FM frequency band, the setting range which is determined by the above-mentioned method and in which the defogger has almost no influence on the antenna characteristics is:

$$70\text{ cm}\le\frac{\lambda}{4}\le 100\text{ cm}$$

In a vehicle mounted state, multiplication with the glass shortening ratio ($\beta$=0.6) yields:

$$42\text{ cm} \le \beta \cdot \frac{\lambda}{4} \le 60\text{ cm},$$

That is, $$42\text{ cm} \leqq L+\alpha \cdot Y < 60\text{ cm}$$

Note that the relationship of equation (1) above holds under the assumption of an ideal state wherein the end portion of the bus bar (one of 10 and 11) of the defogger 5 is short-circuited to the vehicle body. For this reason, in an actual vehicle, since the bus bar and the body are considered to be connected by certain capacitive coupling, a preferable range of L+α·Y for an FM radio is experimentally obtained to be:

$$20\text{ cm} \leqq L+\alpha \cdot Y \leqq 70\text{ cm} \quad (3)$$

When this antenna is used in North America where the FM radio frequency band falls within the range from 88 MHz to 108 MHz, an antenna satisfying the following relation is suitable:

$$40\text{ cm} \leqq L+\alpha \cdot Y \leqq 50\text{ cm}$$

On the other hand, as for the FM radio frequency band falling within the range from 76 MHz to 90 MHz in Japan, an antenna set to satisfy the following relation can exhibit a particularly preferable performance:

$$50\text{ cm} \leqq L+\alpha \cdot Y \leqq 60\text{ cm}$$

In practice, since radio waves in a wide frequency band are to be received like in reception of radio waves in the FM radio frequency band, it is preferable to set L+α·Y to be a length matching substantially the central frequency of the frequency band to be received, as a matter of course.

Figure 8:
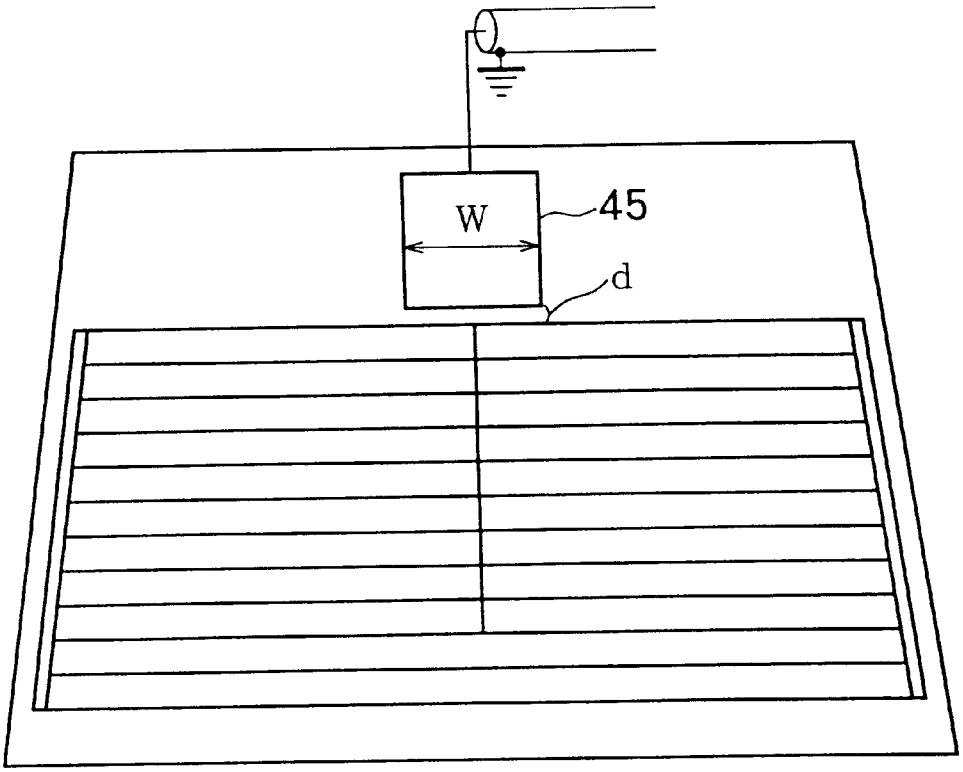
FIG. 8 is a view showing a glass antenna constituted based on the principle shown in FIGS. 3 to 7.
Figure 9:
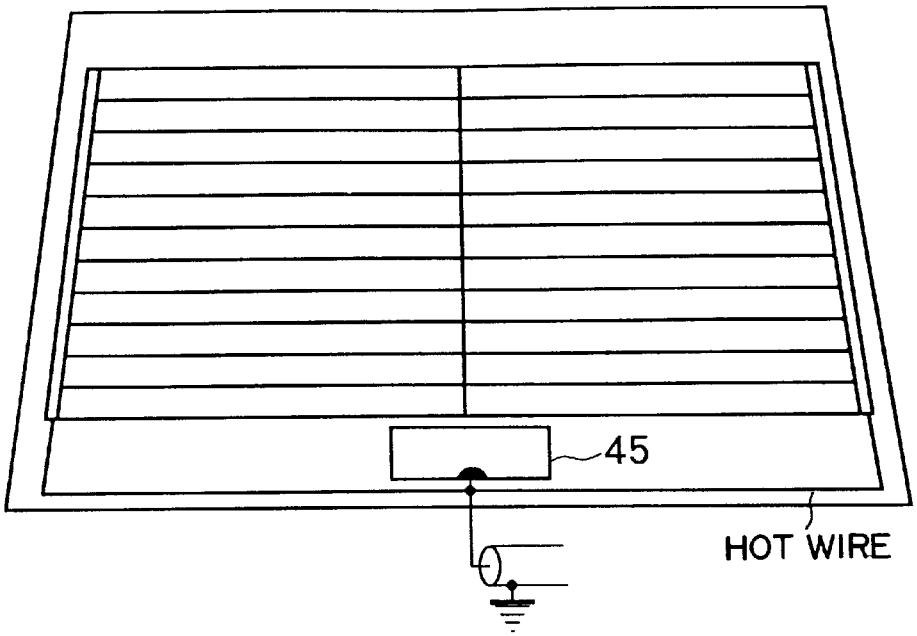
FIG. 9 is a view showing another example of a glass antenna constituted based on the principle shown in FIGS. 3 to 7.
Figure 10:
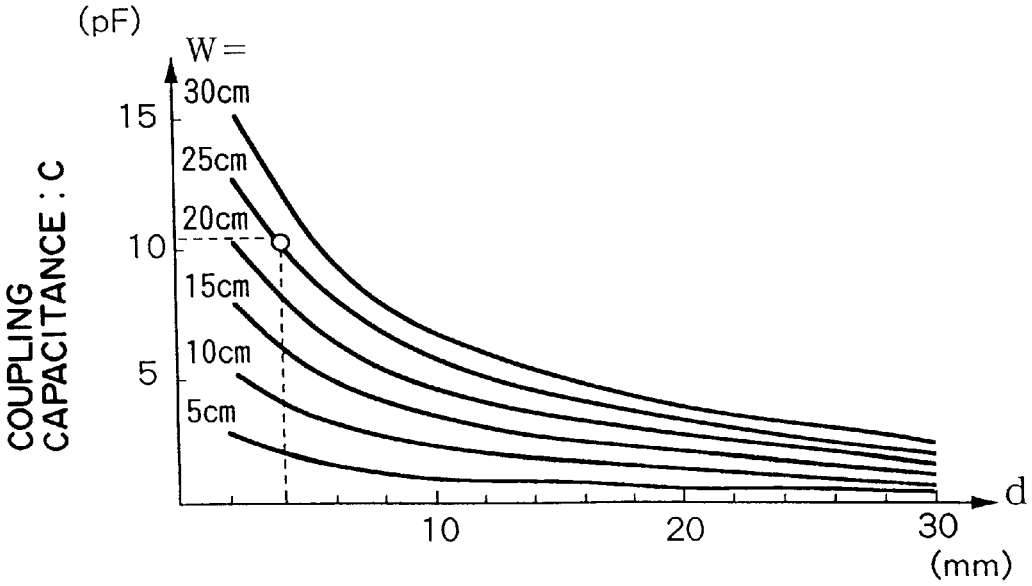
FIG. 10 is a graph showing the relationship between the coupling capacitance C and the interval, d, in each embodiment of the present invention.

FIGS. 8 and 9 show antenna systems in which the portion of the linear conductor wire 40 in FIG. 3 is replaced by a loop antenna conductor wire 45. The feature of the loop antenna conductor wire is that it has a width W in the widthwise direction of the vehicle. When such a loop conductor wire is used, the coupling capacitance can be easily set by changing W. FIG. 10 summarizes a change in coupling capacitance when the width W of the loop conductor wire 45 is varied, and when the distance, d, between the loop conductor wire 45 and the defogger hot wire 6 is varied.

The glass antenna having a pattern shown in FIG. 8 can obtain a sufficient antenna performance. Since this antenna is superior to a conventional rear pole antenna (a 90-cm long rod antenna) in terms of maintenance, wind noise, and the like, its practical value is especially large.

As shown in FIG. 9, in an example wherein the loop conductor wire 45 (W=20 cm) is arranged below the defogger, and electric power is supplied to this antenna 45 at the central portion of the defogger, a high performance can be obtained as well.

According to the findings (e.g., Japanese Patent Application No. 6-205767) of the present inventors, when a mono-pole antenna is mounted on a vehicle as a glass antenna, a high-performance antenna is obtained within the range of:

$$20\text{ cm } L_x \leqq 70\text{ cm} \quad (4)$$

where $L_x$ is the length of the mono-pole antenna.

The above-mentioned antenna system can also be applied to the TV VHF band as long as it is set to satisfy equation (1), as described above.

At the wavelengths (92 MHz to 222 MHz) of the TV VHF band, the range in which the defogger has almost no influence on the antenna characteristics must be set to satisfy:

$$34\text{ cm} \le \frac{\lambda}{4} \le 82\text{ cm}$$

In a vehicle mounted state, the above range is multiplied with the glass shortening ratio (β=0.6) to have:

$$20\text{ cm} \le \beta \cdot \frac{\lambda}{4} \le 50\text{ cm}$$

That is, $$20\text{ cm } L+\alpha \cdot Y \leqq 50\text{ m} \quad (5)$$

As described above, equation (1) holds under the assumption of an ideal state wherein the end portion of the bus bar of the defogger is short-circuited to the vehicle body. For this reason, in an actual vehicle mounted state, since the bus bar and the body are considered to be connected by certain capacitive coupling, the preferable range of L+α·Y for the TV VHF band becomes slightly broader than that in its ideal state like in the antenna for the FM frequency band, i.e., falls within the range from 10 cm to 60 cm. Furthermore, in order to assure a sufficient reception performance over the entire VHF band in a practical use, the length L+α·Y is preferably set to match substantially the central frequency in the VHF band, as a matter of course.

In the glass antenna shown in FIG. 9, the conductor wire 45 is capacitively coupled to the lower portion of the defogger, and is surrounded by another hot wire. The conductor wire 45 does not contact the hot wire although it is surrounded by the hot wire. Therefore, the conductor wire 45 is subjected to almost no influence by a DC current flowing through the hot wire. In addition, a glass region around the conductor wire 45 is heated by this hot wire and can be prevented from fogging.

<Examples of Capacitive Coupling Antenna System>

Figure 11:
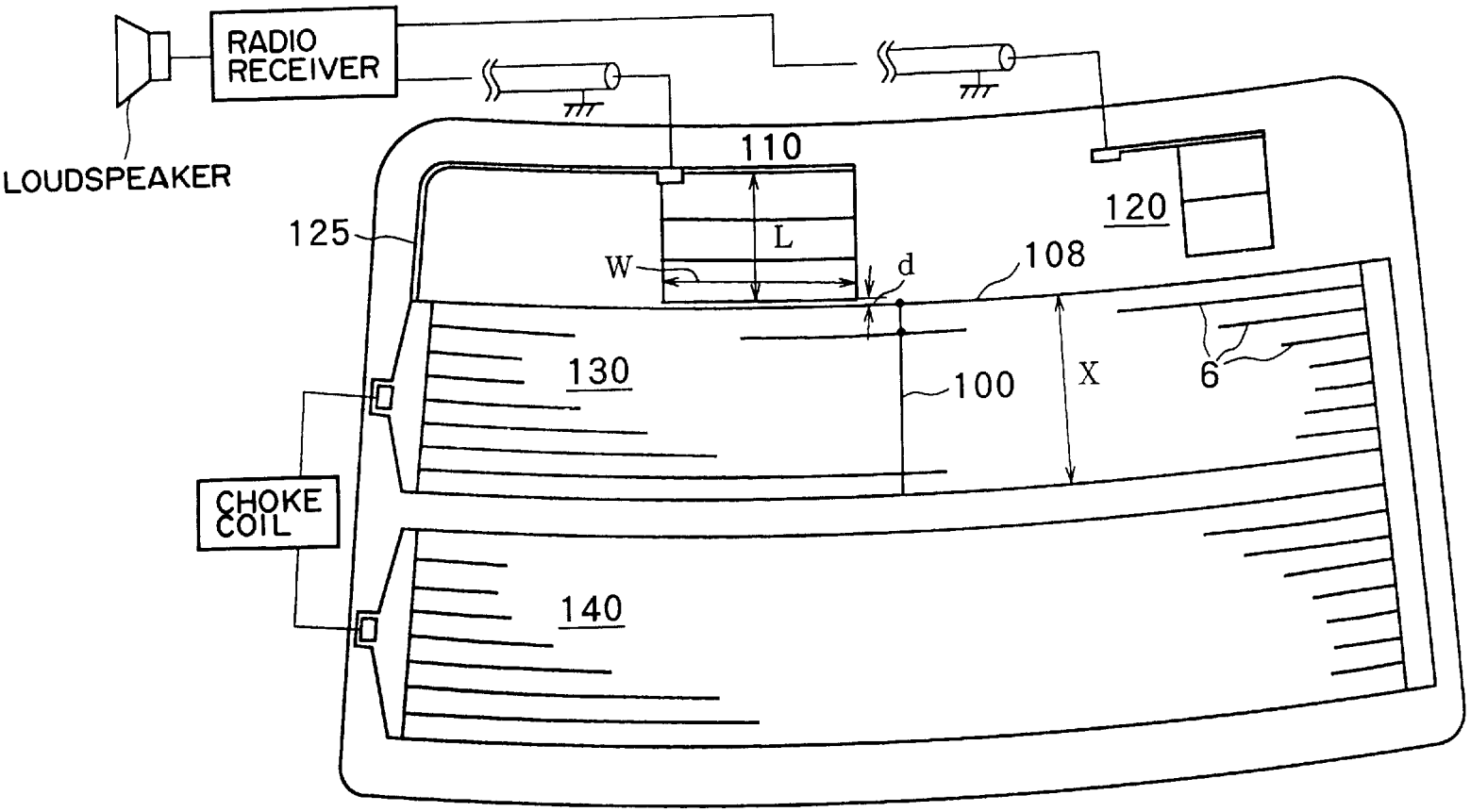
FIG. 11 is a view showing the arrangement of an antenna system when two capacitively coupled circuits are disposed in parallel with each other by developing the principle shown in FIGS. 3 to 10.
Figure 12:
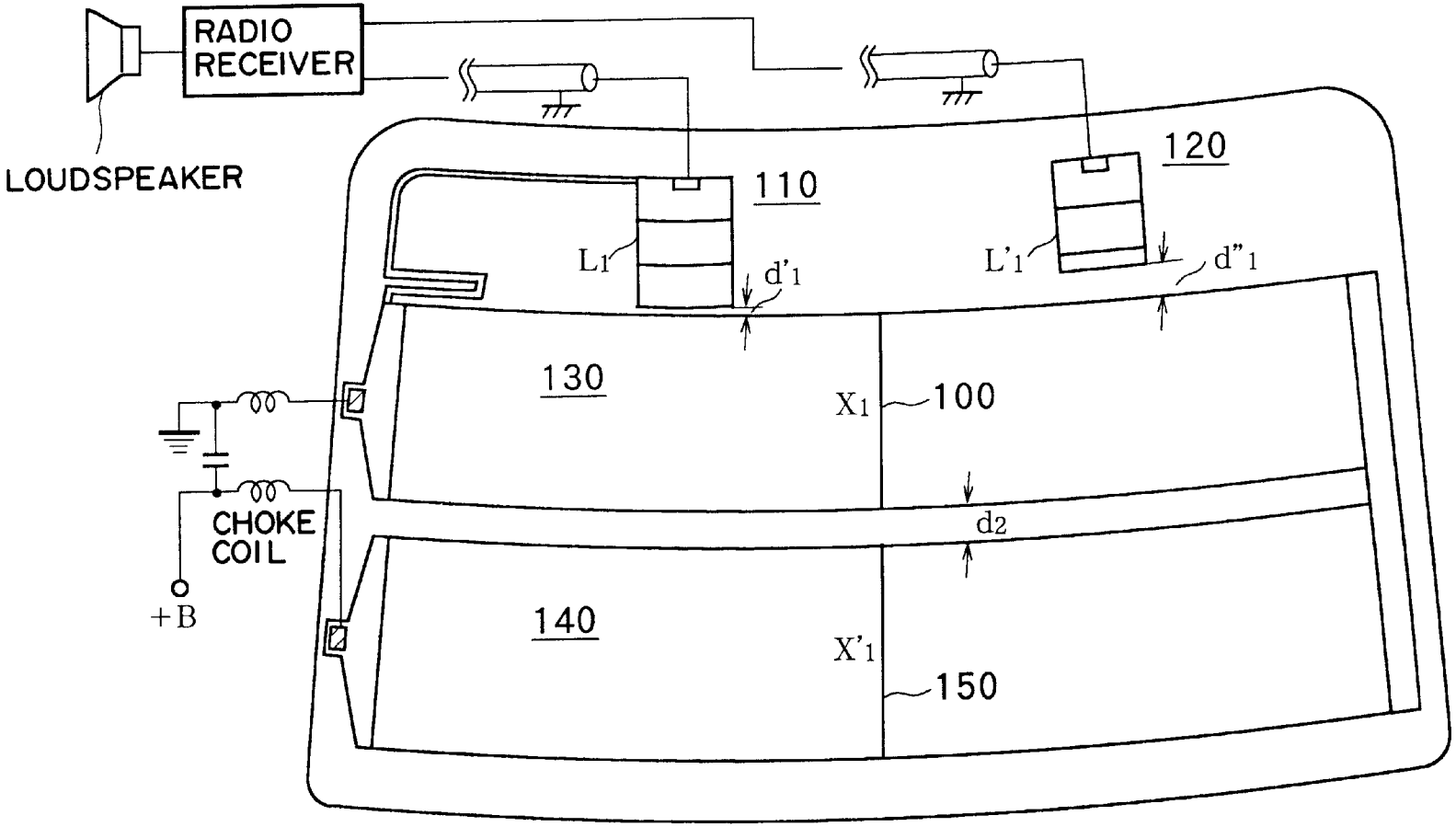
FIG. 12 is a view showing the arrangement of an antenna system when two capacitively coupled circuits are disposed in parallel with each other by developing the principle shown in FIGS. 3 to 10.

Glass antennas each of which includes two antennas applicable to an actual vehicle by extending the concept of the above-mentioned glass antenna will be described below with reference to FIGS. 11 and 12. Note that FIGS. 11 and 12 are views when viewed from the interior of the vehicle unlike the glass antenna in FIG. 3. Therefore, the right-and-left direction is reversed to that in FIG. 3.

The defogger is divided into two regions 130 and 140. A conductor wire 100 is disposed at the center of the defogger region 130 to cross a plurality of hot wires 6. Since the conductor wire 100 having a length x is connected to the hot wires 6 at the center, in the widthwise direction of the vehicle, of the hot wires 6, no heater current flows through the wire 100. In order to constitute an antenna system which includes two reception antennas (e.g., FM diversity antennas or reception antennas respectively for the FM and TV broadcasts), two antennas 110 and 120 are disposed to be capacitively coupled to an uppermost hot wire 108. The feed points of these antennas are connected to a radio receiver and a loudspeaker via coaxial feeder lines without going through any antenna boosters.

The antenna 110 serving as a main antenna element has a

"⊟"

shape. The antenna 120 as a sub antenna element has a

"⊟"

or

"⊟"

shape. The antenna 110 has a height L and a width W. Therefore, L, W, d, and the like are determined to be optimal values ($\alpha$ is determined by W and d) which satisfy equations (1) to (3) above.

Upon actual setting of the antenna system, a combination of the height L and the coupling capacitance C (associated with the shortening ratio a) of the first antenna conductor wire element (main antenna element 110), which combination can prevent the defogger from influencing the antenna performance, is determined from the wavelength (central one) $\lambda$ of the radio wave to be received and the length Y of the defogger disposed on the glass on the basis of the relationship given by equation (1) above. The dimensions W and d are determined on the basis of the value of the coupling capacitance C.

Subsequently, the length X of the conductor wire 100 is determined on the basis of the following relation with an optimal mono-pole antenna length ($L_x$) which is obtained by, e.g., experiments, in units of vehicles:

$$L+\alpha\cdot X=L_x \tag{6}$$

Note that the value $L_x$ falls within the range from 20 cm to 70 cm in a normal use state when FM radio waves are to be received, and this range is the same as the above-mentioned range. The width W of the main antenna 110 preferably falls within the range from 50 mm to 300 mm, and more preferably, within the range from 100 mm to 250 mm. The height L preferably falls within the range from 40 mm to 300 mm.

A conductive wire 125 extends from the feed point of the main antenna 110, and is connected to a bus bar in the defogger region 130. Since the antenna 110 which is originally used as an FM antenna is connected to the bus bar of the defogger via the conductive wire 125, the resonance point of the antenna 110 is also generated in an AM region, and hence, the antenna 110 can also be used as an AM antenna.

In the antenna system shown in FIG. 12, a conductor wire 150 is added in the defogger region 140 in addition to the antenna conductor wire 100 disposed in the defogger region 130 in the antenna system shown in FIG. 11. Let $L_1$ be the height of the antenna 110, $L_1'$ be the height of the antenna 120, $d_1'$ be the distance between the antenna 110 and the hot wire, $d_1''$ be the distance between the antenna 120 and the hot wire, X1 be the length of the conductor wire 100, $X_1'$ be the length of the conductor wire 150, and $d_2$ be the distance between the defogger regions 130 and 140.

Then, if relations (7) and (8) below are satisfied respectively for the antennas 110 and 120, it is determined that these antennas have preferred antenna lengths, and a glass antenna system with a good performance can be provided:

$$20\text{ cm}\leqq L_1+\alpha_1\cdot(X_1+\alpha_2X_1')\leqq 70\text{ cm} \tag{7}$$

$$20\text{ cm}\leqq L_1'+\alpha_1'\cdot(X_1+\alpha_2X_1')\leqq 70\text{ cm} \tag{8}$$

where $\alpha_1$ is the shortening ratio of the antenna 110 by the defogger region 130, $\alpha_1'$ is the shortening ratio of the antenna 120 by the defogger region 130, and $\alpha_2$ is the shortening ratio of the conductor wire 150 by capacitive coupling between the defogger regions 130 and 140.

The design method of the capacitive coupling antenna found by the present inventors, and the arrangement of the antenna system designed by the method have been described.

<Improvement of Rear View>

In the glass antenna shown in each of FIG. 3, 8, or 9, a mono-pole antenna element (the wire 41 in FIG. 3 or the vertical antenna in FIG. 8 or 9) arranged in the defogger region and an antenna conductor wire element (the vertical antenna 40 in FIG. 3 or the loop antenna element 45 shown in FIG. 8 or 9) arranged outside the defogger region are capacitively coupled to each other to serve as a single antenna. On the other hand, the design method of the capacitive coupling antenna shown in FIGS. 3 to 10 can easily and reliably attain a required target performance. However, in the glass antenna shown in each of FIG. 3, 8, or 9, since the mono-pole antenna element is set at the center in the defogger region, it may disturb a rear view.

In the following description, the horizontal direction means a direction parallel to the widthwise direction of the vehicle along the surface of the rear window glass, and the vertical direction means a direction perpendicular to the horizontal direction along the glass surface.

First Embodiment

Figure 13:
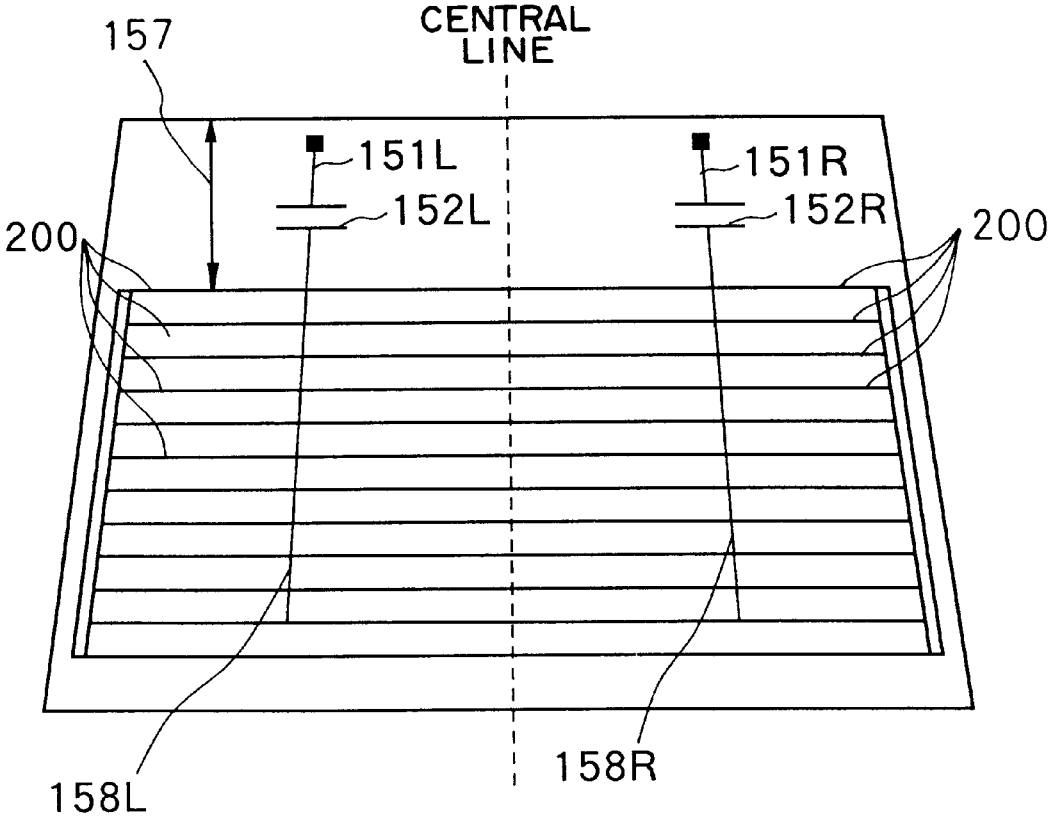
FIG. 13 is a view for explaining the basic arrangement of an antenna system according to the first embodiment of the present invention.

FIG. 13 shows the basic arrangement of an antenna system constituted by arranging two capacitive coupling antennas on the glass surface. The antenna system shown in FIG. 13 aims at preventing the deterioration of the rear view.

Referring to FIG. 13, two antenna conductor wires 158L and 158R extend at positions symmetrical about the central line of a defogger. On the left side of the defogger, the antenna conductor wire 158L substantially perpendicularly crosses defogger hot wires 200, and is connected in a DC manner to the hot wires 200 at the respective crossing points. On the right side of the defogger, the antenna conductor wire 158R substantially perpendicularly crosses the defogger hot wires 200, and is connected in a DC manner to the hot wires at the respective crossing points.

The conductor wires 158L and 158R are respectively capacitively coupled to vertical conductor lines 151L and 151R via capacitors 152L and 152R. More specifically, the antenna system shown in FIG. 13 is equivalent to two antenna systems shown in, e.g., FIG. 3, which are arranged on the glass surface.

Since FIG. 13 shows the basic arrangement of the antenna system, the conductor wires 158L and 158R must be vertical wires perpendicular to the defogger hot wires 200, but the antenna conductor wire elements 151L and 151R may be either vertical conductor wires or loop conductor wires. Also, these conductor wires may be conductor wire plates, or may have a

"⊟"

or

"⊟"

shape.

Furthermore, the capacitors 152L and 152R may be replaced by chip capacitor elements in place of using capacitive coupling by parallel conductor wires shown in FIG. 3.

As described above, according to the antenna system of the first embodiment, since the defogger hot wires are present at the central portion of the window glass but no antenna conductor wires are present, nothing that disturbs the rear view of a driver is present in the defogger region. Also, since neither the hot wires nor the antenna conductor wires are present at substantially the central portion, in the widthwise direction of the vehicle, of the upper portion of the window glass that largely influences the rear view of the driver, a good rear view can be assured.

Second Embodiment

Figure 14:
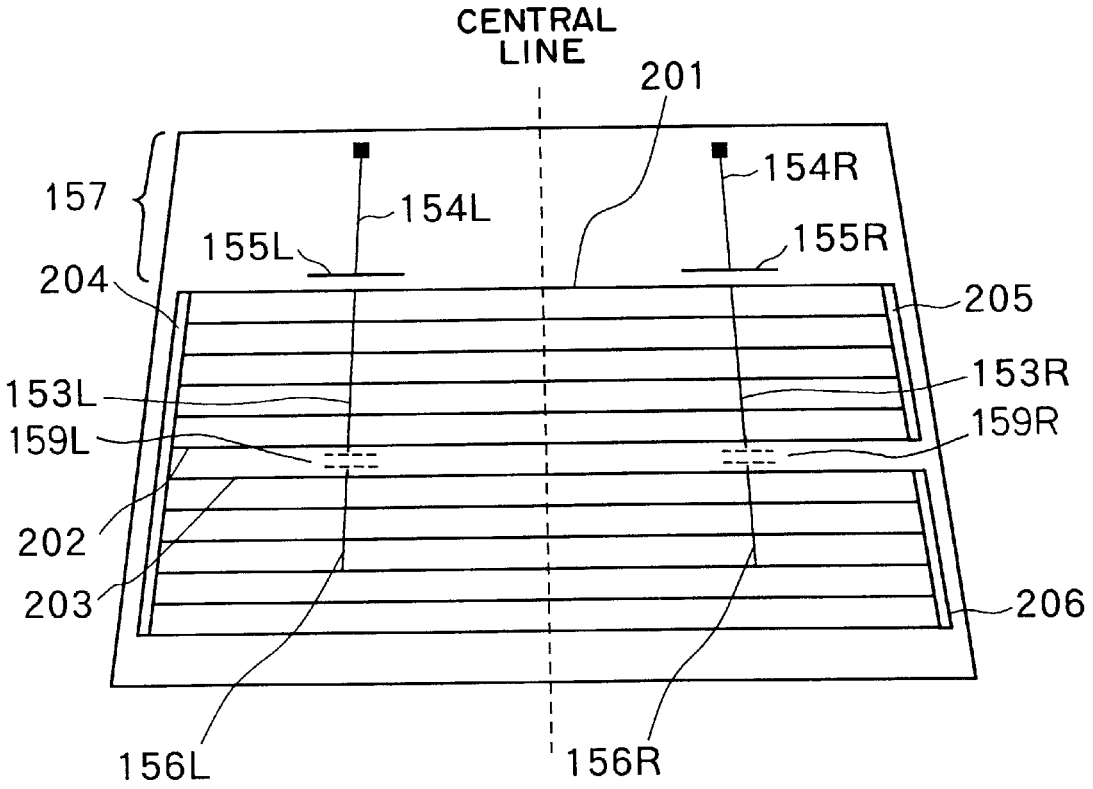
FIG. 14 is a view for explaining the arrangement of an antenna system according to the second embodiment.

FIG. 14 shows an embodiment which further embodies the basic arrangement shown in FIG. 13.

In an antenna system shown in FIG. 14, the defogger is divided into two portions (into a U shape). Reference numeral 204 denotes a common bus bar, which is connected to a plus DC power supply via a bus bar 205, and is connected to a minus DC power supply via a bus bar 206.

An upper vertical conductor wire 153L arranged on the left side in FIG. 14 crosses uppermost to sixth defogger hot wires 201 to 202, and is connected thereto in a DC manner. Similarly, an upper vertical conductor wire 153R arranged on the right side crosses the hot wires 201 to 202, and is connected thereto in a DC manner. Furthermore, a lower left vertical conductor wire 156L (lower right vertical conductor wire 156R) extends across a seventh hot wire 203 to the 10th hot wire while being connected thereto.

On the left side of a blank region 157 where no defogger hot wires are arranged, a vertical conductor wire 154L extends substantially vertically, and also on the right side, a vertical conductor wire 154R extends substantially vertically. The vertical conductor wire 154L (154R) is connected in a DC manner to a horizontal conductor wire 155L (155R). Therefore, the vertical conductor wire 154L (154R) is capacitively coupled to the vertical conductor wire 153L (153R) via a capacitor formed by the horizontal conductor wire 155L (155R) and the uppermost hot wire 201.

Furthermore, the vertical conductor wire 153L (153R) in the defogger region is capacitively coupled to the vertical conductor wire 156L (156R) in the defogger region via a capacitor 159L (159R) formed by the hot wires 202 and 203. Note that the relationship between the vertical conductor wires 153L (153R) and 156L (156R) is the same as that between the conductor writes 100 and 150 in FIG. 12. More specifically, in the second embodiment, the lengths of the antenna conductor wires are determined according to equations (7) and (8).

In the antenna system shown in FIG. 14, one or both of the antenna conductor wires 154L and 154R may receive power supply.

In the second embodiment, a sufficient rear view can be assured as in the antenna system of the first embodiment.

Third Embodiment

Figure 15:
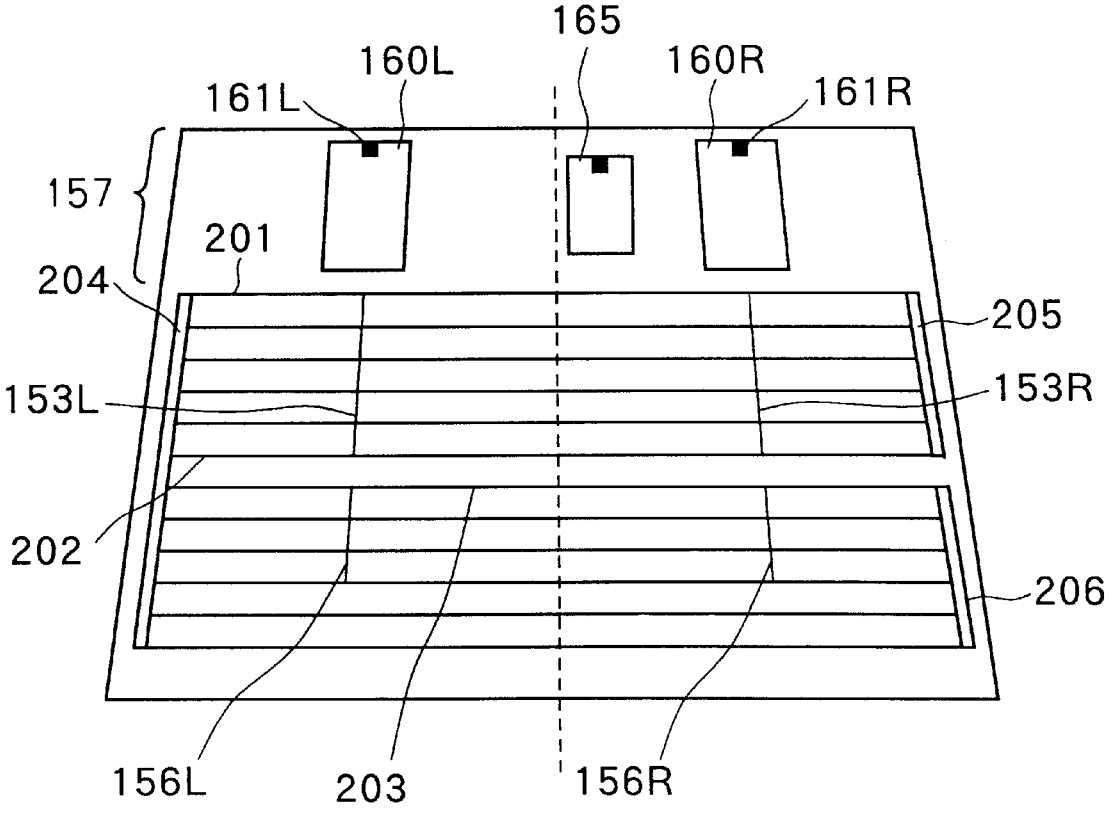
FIG. 15 is a view for explaining the arrangement of an antenna system according to the third embodiment.

An antenna system of the third embodiment shown in FIG. 15 is substantially the same that of the second embodiment in FIG. 14, except that the antenna system of the third embodiment has loop antenna conductor wires 160L and 160R in place of the two antenna conductor wires 154L and 154R in the second embodiment. Note that reference numeral 161L (161R) denotes a feed point.

Referring to FIG. 15, reference numeral 165 denotes an antenna different from the antenna 160L (160R). In the antenna system described in each of the first to third embodiments, since the two sets of antennas are arranged on the right and left sides of the defogger, a blank portion is formed at the central portion of the upper portion of the glass. Thus, in the third embodiment, another antenna 165 is arranged on the blank portion.

In the third embodiment, the independent antenna 165 is arranged on the blank portion of the upper portion of the glass. Alternatively, a high-mount stop lamp or a rear monitor camera may be placed on the rear dashboard.

Experimental Results of First to Third Embodiments

The characteristics of the antenna system shown in FIG. 14 will be described below.

Figure 16:
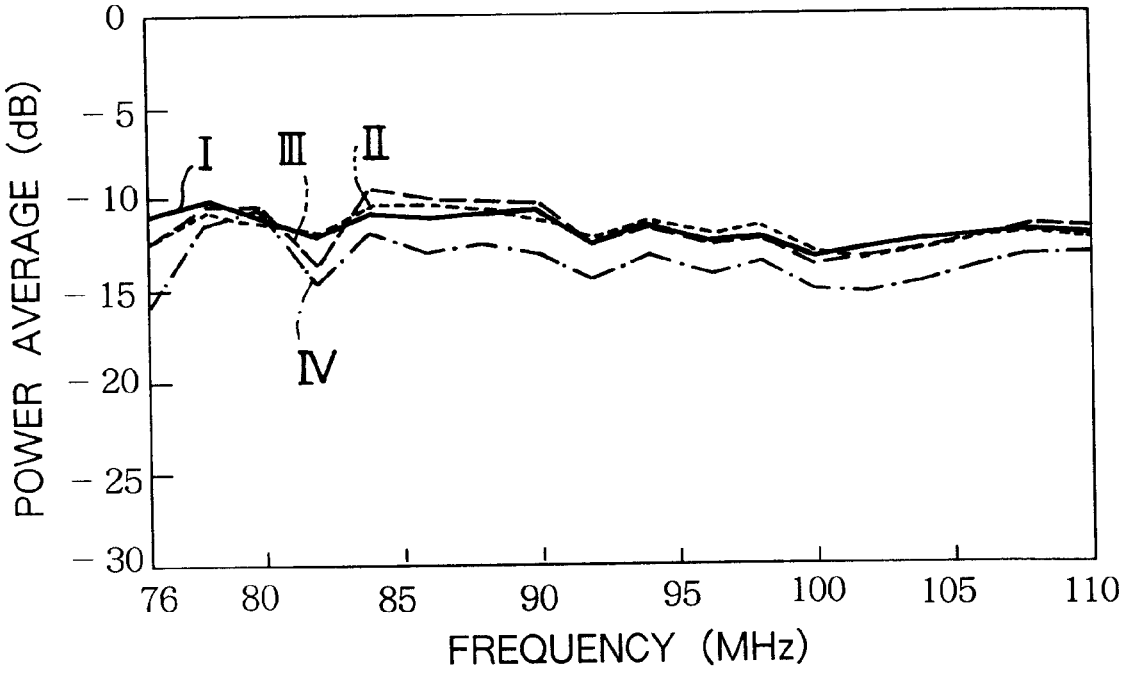
FIG. 16 is a graph for explaining the reception characteristics of the antenna system of the second embodiment.
Figure 17:
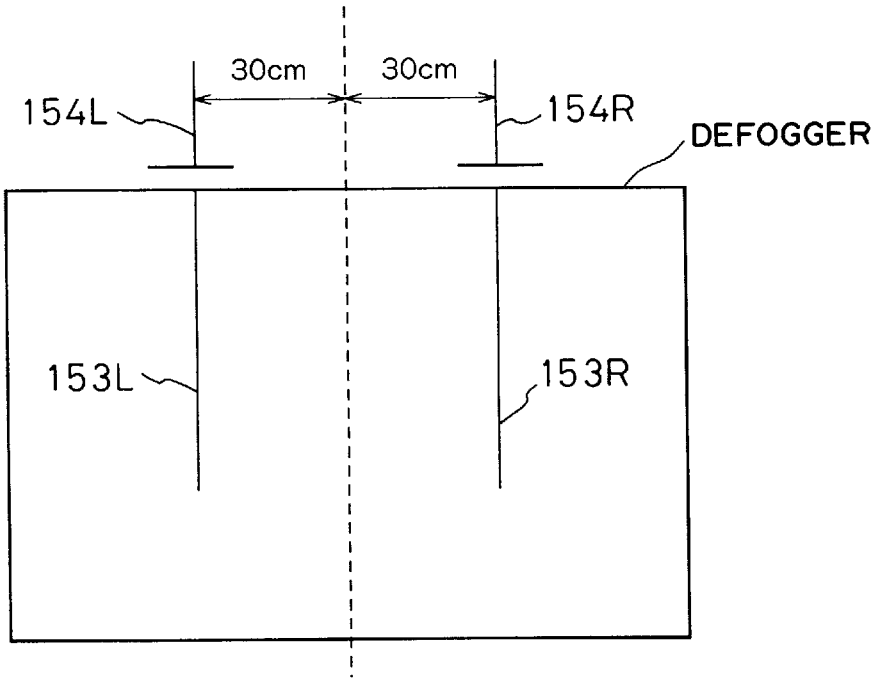
FIG. 17 is a view showing the disposition of an antenna system used to obtain the experimental results shown in FIG. 16.
Figure 18:
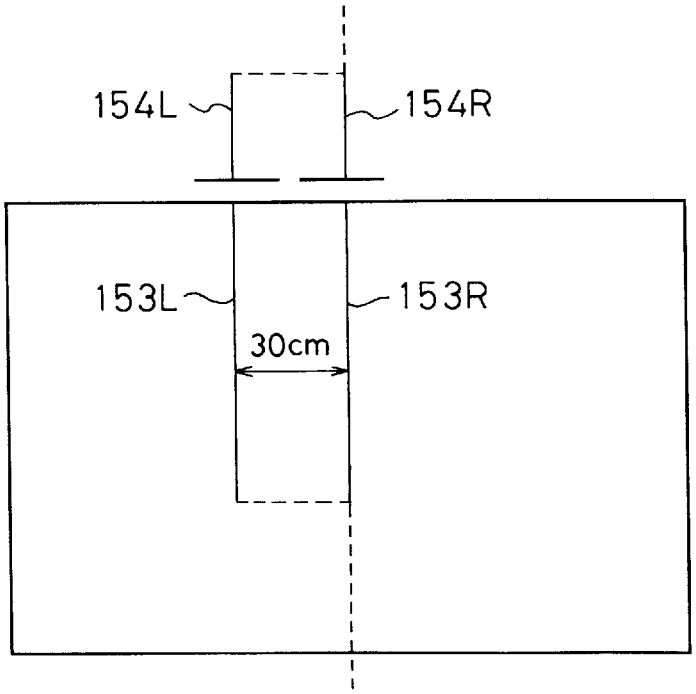
FIG. 18 is a view showing the disposition of an antenna system used to obtain the experimental results shown in FIG. 16.

A solid curve I and a broken curve II shown in FIG. 16 respectively represent the reception strengths of the right and left conductor wires 154R and 154L obtained when the two antenna conductor wires shown in FIG. 14 are disposed at the positions (separated by 30 cm from the center) about the center of the glass, as shown in FIG. 17. On the other hand, broken curves III and IV in FIG. 16 respectively represent the reception strengths of the right and left conductor wires 154R and 154L obtained when the right antenna conductor wire 154R in FIG. 14 is disposed at the center of the glass, and the left conductor wire 154L is arranged at a position offset by 30 cm from the center of the glass (i.e., at asymmetrical positions), as shown in FIG. 18.

As can be seen from FIG. 16, the two antenna conductor wires arranged at symmetrical positions have reception sensitivity superior to that arranged at asymmetrical positions.

Figure 19:
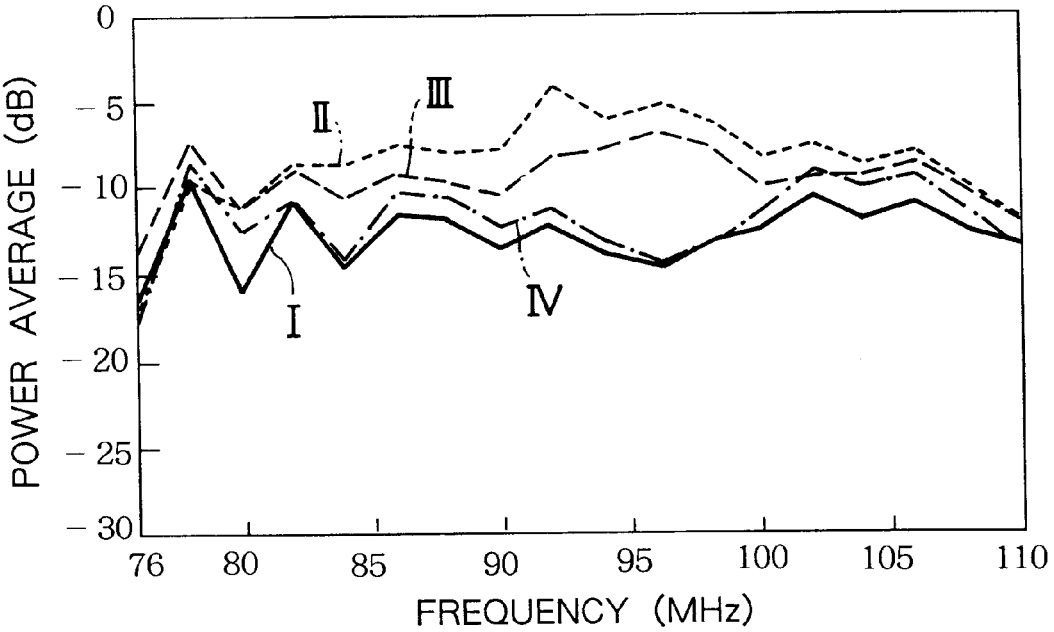
FIG. 19 is a graph for explaining the reception characteristics of the antenna system of the second embodiment.

FIG. 19 shows the reception strengths obtained when the setting position of capacitive coupling is varied in the antenna system shown in FIG. 14. In FIG. 19, a solid curve I represents the reception strength obtained when the antenna conductor wires 154 and 153 are directly coupled to each other without any capacitive coupling. A broken curve II represents the reception strength obtained when the antenna conductor wires 154 and 153 are capacitively coupled to each other to sandwich the uppermost hot wire (the hot wire 201 in FIG. 14) therebetween. A broken curve III represents the reception strength obtained when the antenna conductor wires 154 and 153 are capacitively coupled to each other to sandwich the second uppermost hot wire therebetween. An alternate long and short dashed curve Iv represents the reception strength obtained when the antenna conductor wires 154 and 153 are capacitively coupled to each other to sandwich the third uppermost hot wire therebetween.

Figure 20:
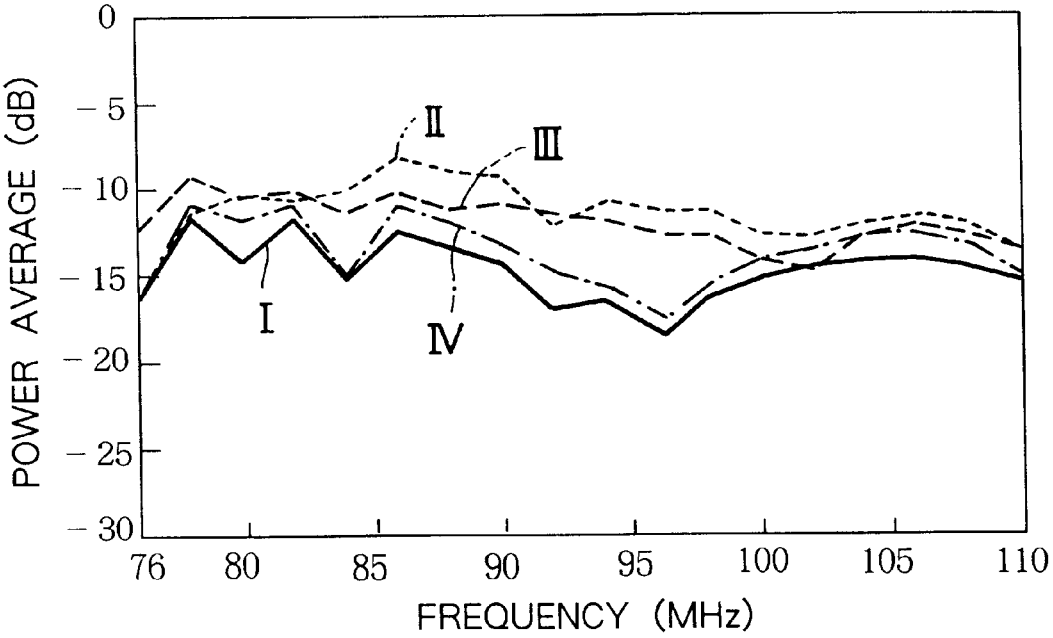
FIG. 20 is a graph for explaining the reception characteristics of the antenna system of the second embodiment.

FIG. 19 is a graph showing the characteristics obtained upon reception of vertical polarized plane waves, and FIG. 20 is a graph showing the characteristics obtained upon reception of horizontal polarized plane waves.

As can be seen from the graphs in FIGS. 19 and 20, an antenna system with a good performance can be constituted when capacitive coupling is obtained at the position of the uppermost or second uppermost hot wire.

Figure 21:
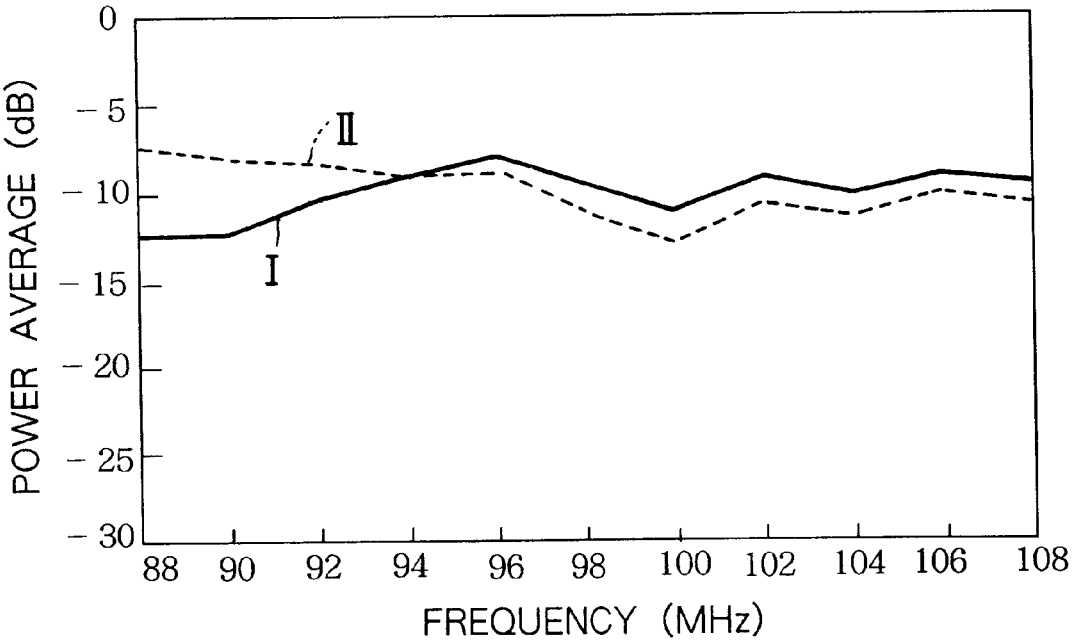
FIG. 21 is a graph for explaining the reception characteristics of the antenna system of the second embodiment.
Figure 22:
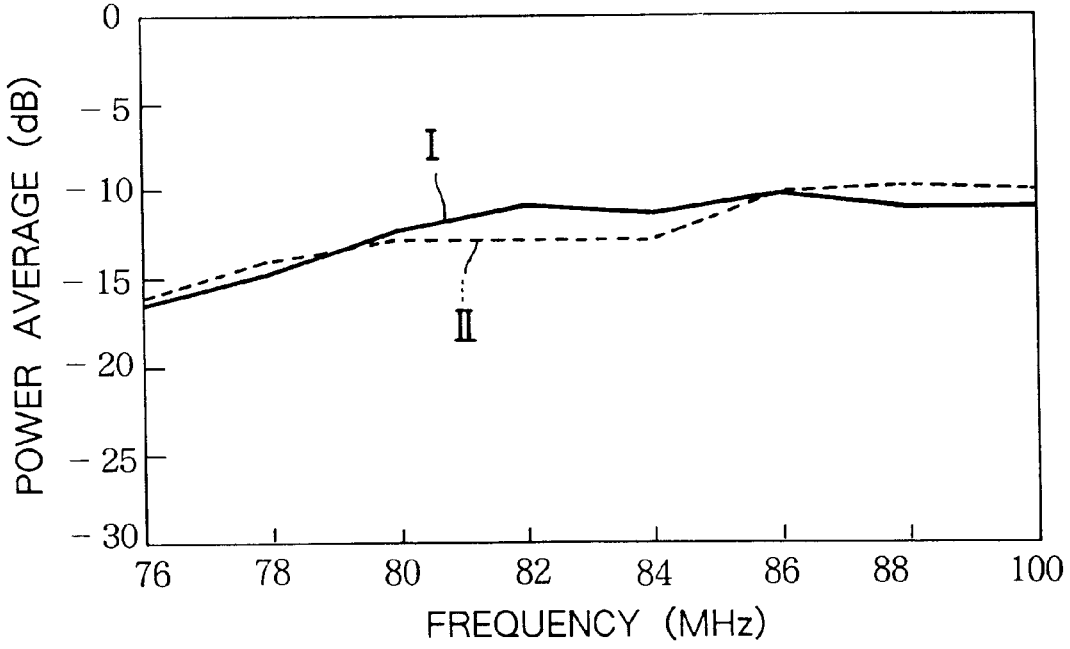
FIG. 22 is a graph for explaining the reception characteristics of the antenna system of the second embodiment.
Figure 23:
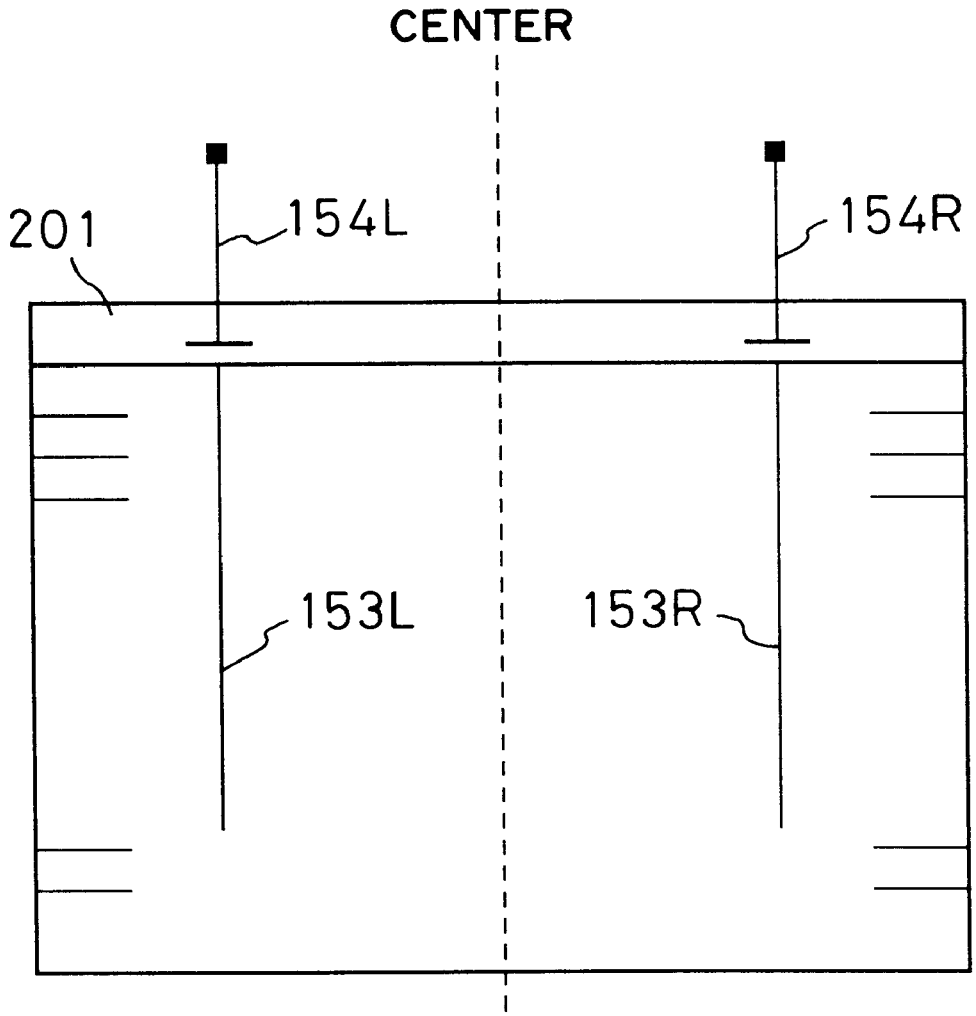
FIG. 23 is a view showing the disposition of an antenna system used to obtain the experimental results shown in FIGS. 21 and 22.

FIG. 21 shows the reception characteristics of the two antennas obtained when the antenna conductor wires shown in FIG. 13 or 14 are disposed, as shown in FIG. 23 (i.e., two antenna conductor wires are disposed at symmetrical positions), and capacitive coupling (its capacitance is adjusted to 15 pF) is obtained at the position of the second uppermost hot wire. A solid curve I in FIG. 21 represents the strength of radio waves received by the right antenna conductor wire when the left antenna conductor wire is terminated, and a broken curve II represents the strength of radio waves received by the left antenna conductor wire when the right antenna conductor wire is terminated. Note that FIG. 21 shows experimental results obtained with vertical polarized plane waves obtained from test radio waves, and FIG. 22 shows experimental results obtained with horizontal polarized plane waves obtained from test radio waves.

As can be seen from FIGS. 21 and 22, the two antenna conductor wires can provide practically sufficient reception sensitivity. This means that the antenna system shown in FIGS. 13, 14, and 15 can be used as a diversity antenna system.

Figure 24:
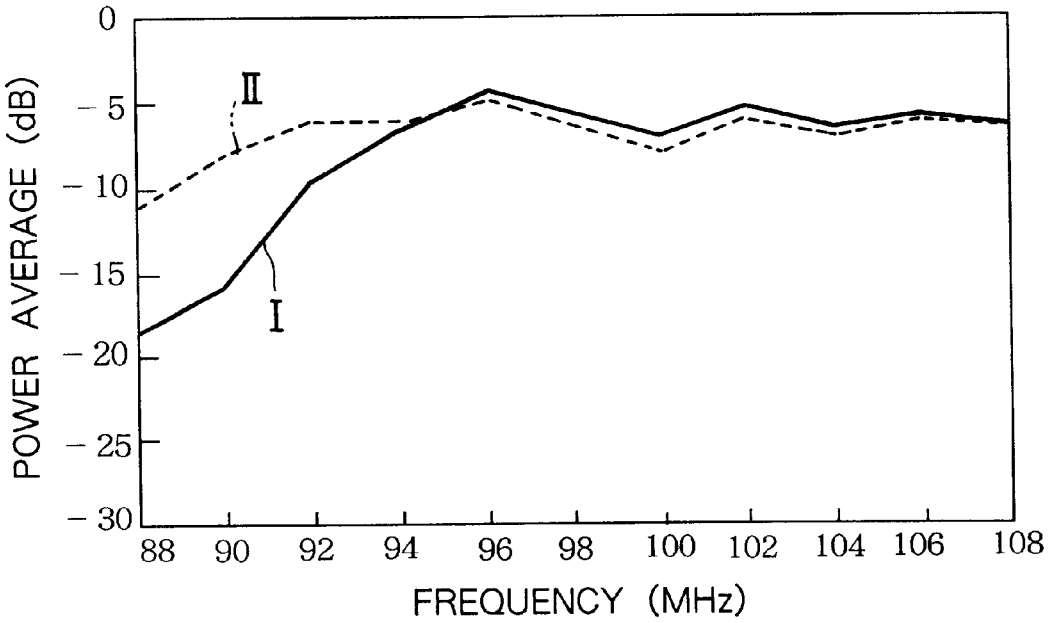
FIG. 24 shows graphs of the experimental results which reveal that the antenna system of the second embodiment serves as a diversity system.

FIG. 24 shows the reception strengths obtained when the antenna system shown in FIG. 13 or 14 is disposed, as shown in FIG. 23, and the coupling capacitance set at the position of the second uppermost hot wire is separately set to be 10 pF and 15 pF. In FIG. 24, a solid curve I represents the reception strength obtained when the coupling capacitance is set to be 10 pF, and a broken curve II represents the reception strength obtained when the coupling capacitance is set to be 15 pF.

Figure 25:
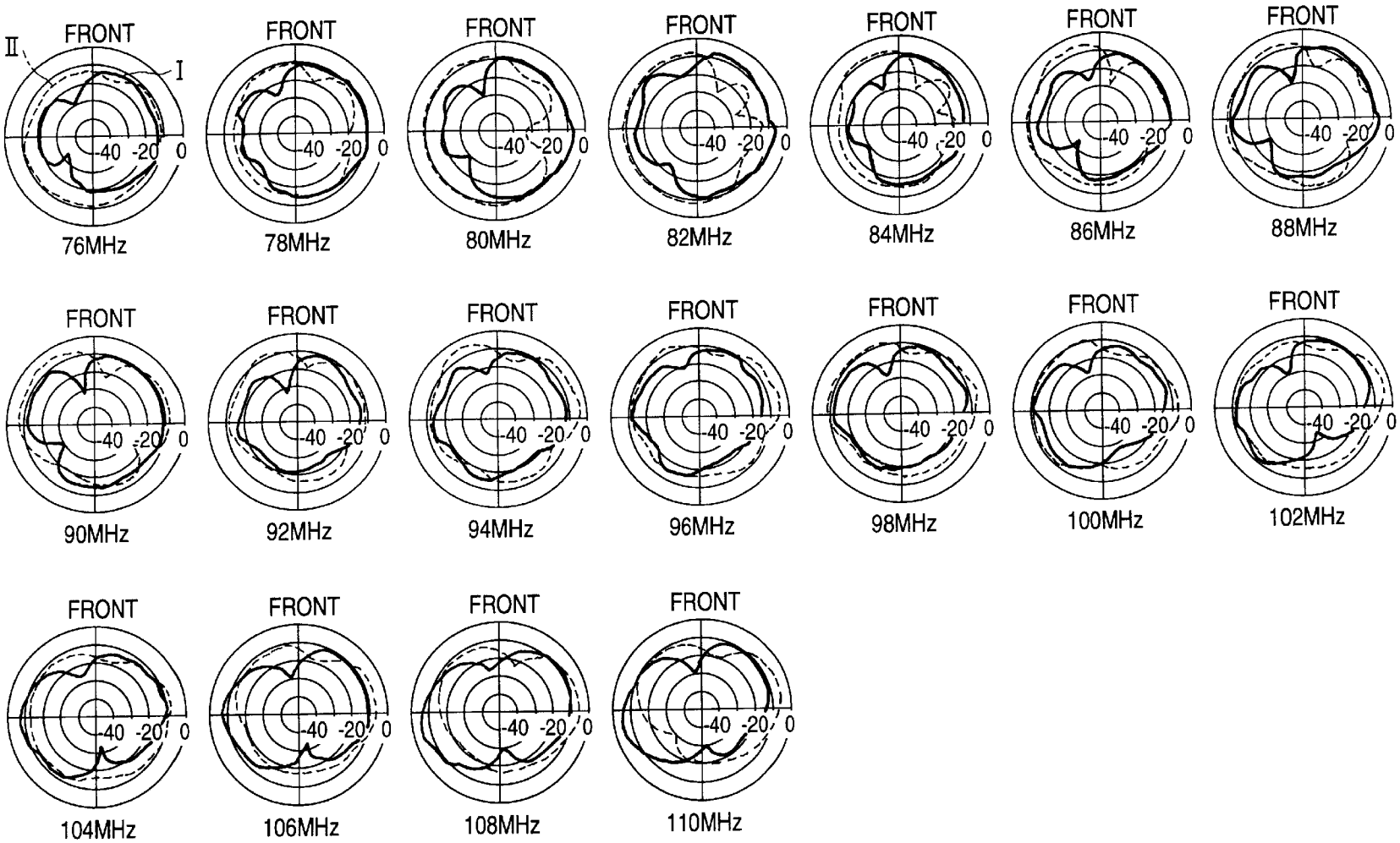
FIG. 25 shows graphs of the experimental results which reveal that the antenna system of the second embodiment serves as a diversity system.
Figure 26:
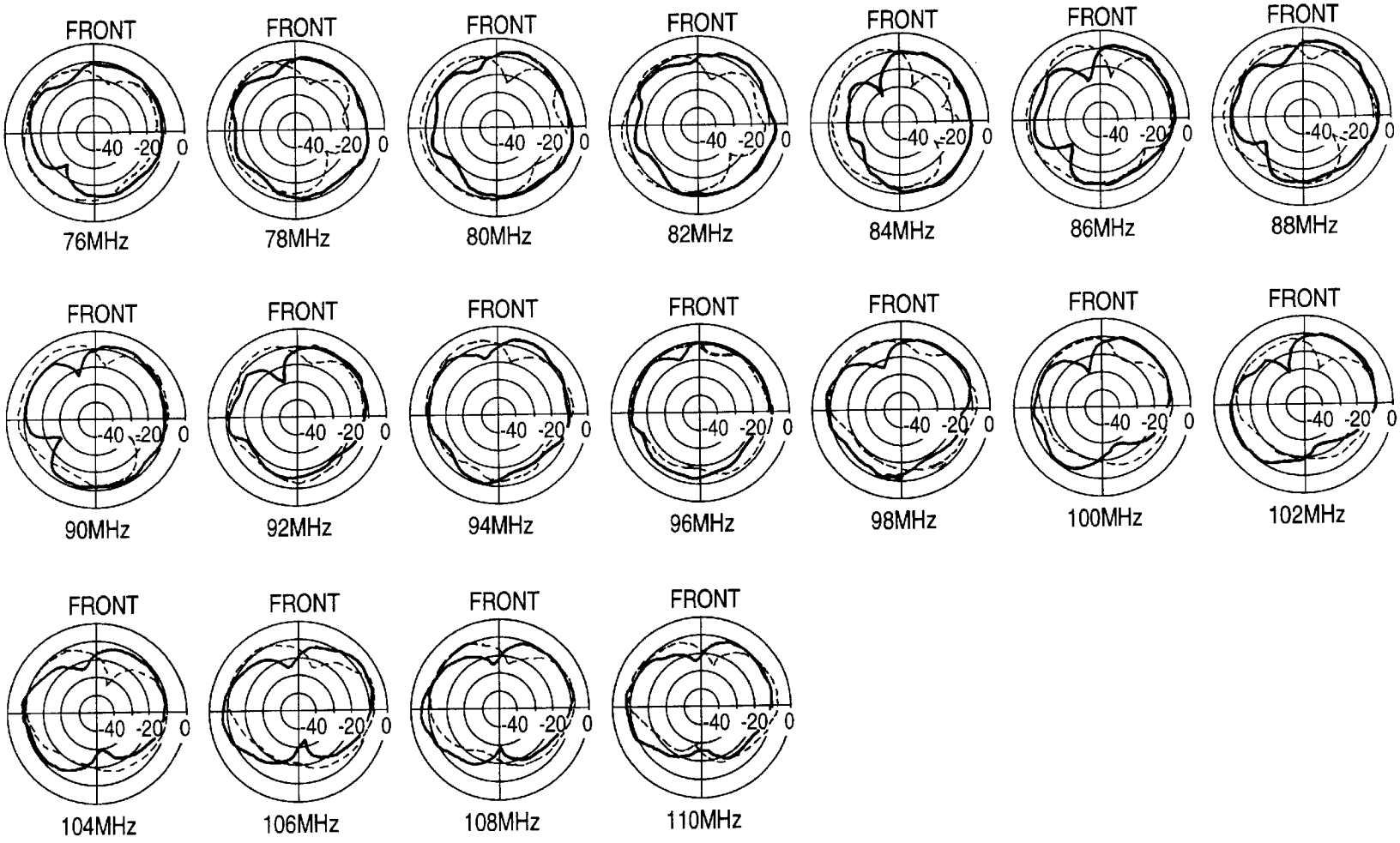
FIG. 26 shows graphs of the experimental results which reveal that the antenna system of the second embodiment serves as a diversity system.

FIGS. 25 and 26 show a change in diversity effect obtained when the interval between the two antenna conductor wires is increased or decreased. In particular, FIG. 25 shows the directivity obtained when the two antenna conductor wires are disposed at right and left positions respectively separated by 40 cm from the center, and the coupling capacitance is set to be 10 pF. A solid curve I represents the output from the right antenna conductor wire, and a broken curve II represents the output from the left conductor wire. FIG. 26 shows the directivity obtained when the two antenna conductor wires are disposed at right and left positions respectively separated by 30 cm from the center, and the coupling capacitance is set to be 10 pF. A solid curve I represents the output from the right antenna conductor wire, and a broken curve II represents the output from the left conductor wire.

Figure 27:
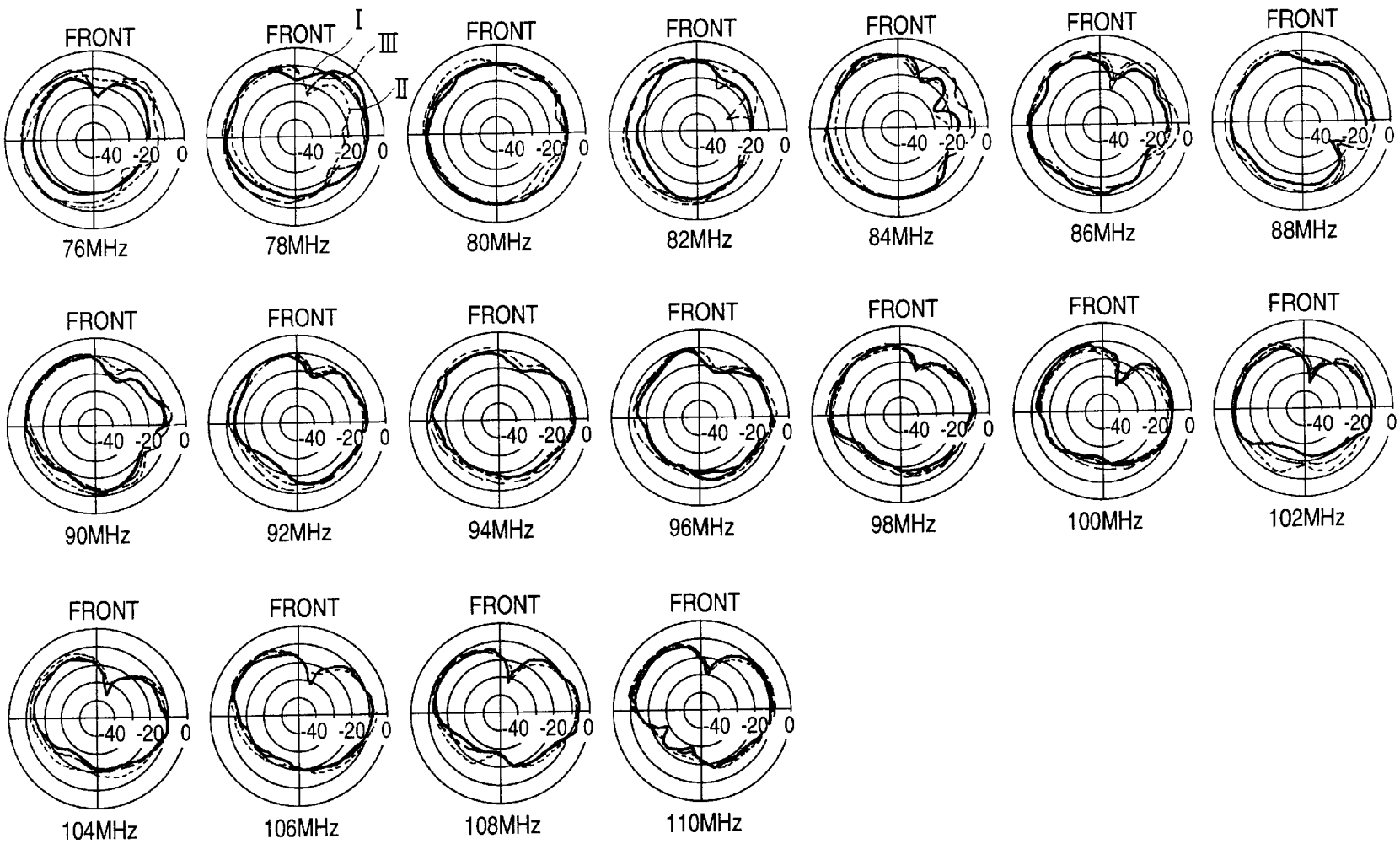
FIG. 27 shows graphs of the experimental results which reveal that the antenna system of the second embodiment serves as a diversity system.
Figure 28:
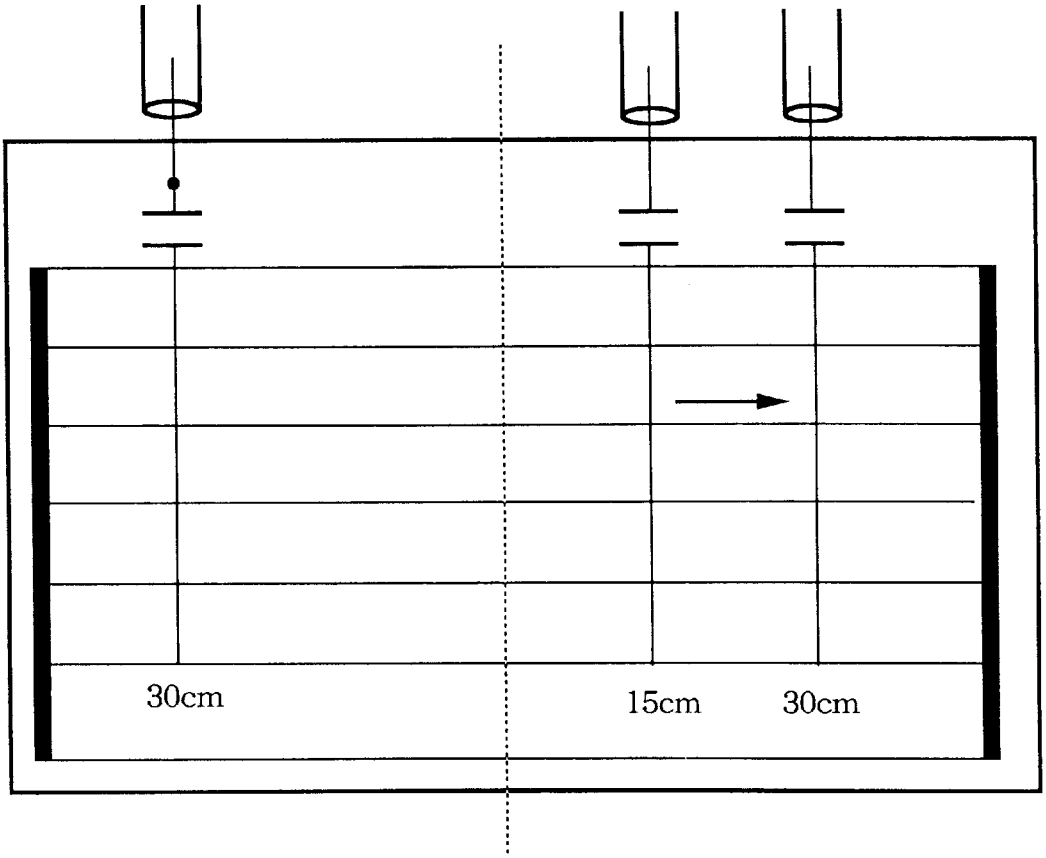
FIG. 28 is a view showing the disposition of an antenna system used to obtain the experimental results shown in FIG. 27.

FIG. 27 shows the outputs from the left antenna conductor wire obtained when the left antenna conductor wire is set at a position separated by 30 cm from the center, and the right antenna conductor wire is disposed at the center, a position separated by 15 cm from the center, and a position separated by 30 cm from the center, as shown in FIG. 28, in the antenna system shown in FIG. 13 or 14. In particular, in FIG. 27, a solid curve I represents the output obtained when the right conductor wire is disposed at the center, a broken curve II represents the output obtained when the right conductor wire is disposed at a position separated by 15 cm from the center, and a broken curve III represents the output obtained when the right conductor wire is disposed at a position separated by 30 cm from the center. In the experiments in FIG. 27, the coupling capacitance is set to be 10 pF.

As can be seen from the graph in FIG. 27, a change in directivity of the left antenna conductor wire becomes larger as the right antenna conductor wire becomes closer to the center.

<Effects of First to Third Embodiments>

According to the first to third embodiments described above, since no FM antenna is disposed at the central portion on the glass unlike in the conventional system, a blank portion is formed at the central portion, and the field of view of a driver at the central portion can be broadened, thus improving rear visibility.

In particular, since the third embodiment can assure a larger defogger blank portion than that in the first embodiment, a loop antenna conductor wire having a higher performance than the pole antenna conductor wire can be set at the central portion. Since the blank portion is broad, a broad rear view can be maintained even when the pole antenna conductor wire is replaced by the loop antenna conductor wire.

According to the first to third embodiments, when the coupling capacitance is set to be equal to or lower than 15 pF, an antenna system which has a high performance for FM reception can be obtained.

Furthermore, according to the first to third embodiments, for example, an antenna (e.g., a TV antenna) other than an FM reception antenna can be set at the broad blank portion.

Figure 29:
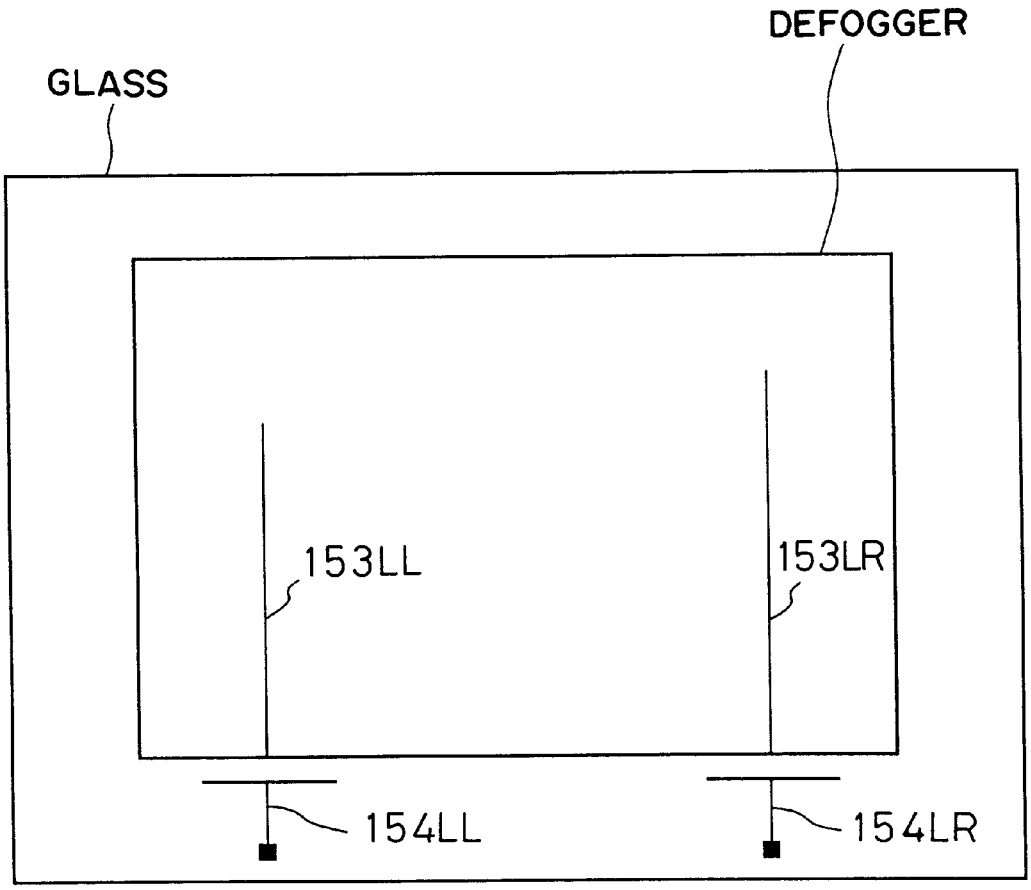
FIG. 29 is a view showing the arrangement of an antenna system according to a modification of the first to third embodiments.

In the glass antenna systems of the first to third embodiments, the defogger blank portion is formed above the defogger. Alternatively, the blank portion may be formed below the defogger, as shown in FIG. 29.

Figure 30:
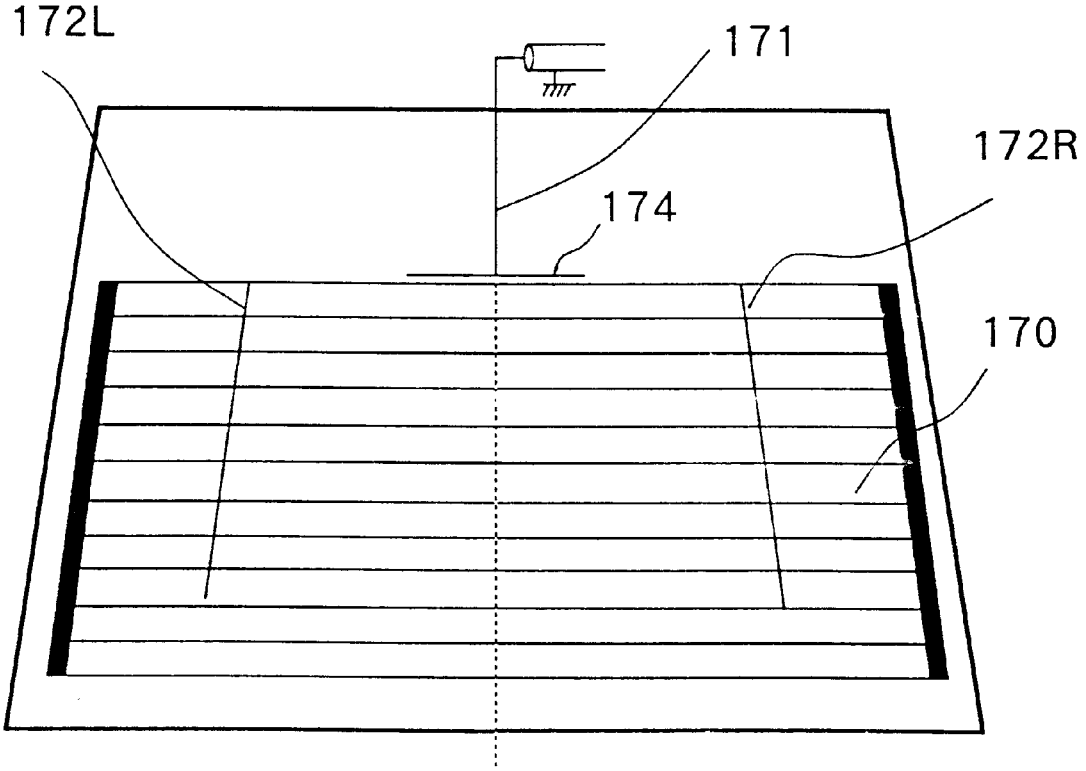
FIG. 30 is a view showing the disposition of an antenna system according to a modification that aims at assuring a sufficient rear view.

FIG. 30 proposes an antenna system as a modification having another structure for assuring a sufficient rear view. In the modification shown in FIG. 30, a region where no defogger extends is assured above a glass antenna, and a defogger 170 extends below the glass antenna. Two parallel conductor wires 172L and 172R are perpendicularly coupled to hot wires of the defogger in a DC manner. A conductor wire 174 having a predetermined length is disposed to extend in a direction parallel to the uppermost hot wire of the defogger 170. A vertical antenna conductor wire element 171 is arranged at substantially the center of the glass on a region where no defogger is arranged, and is connected in a DC manner to the conductor wire 174. Since the antenna conductor wire element 171 is connected to the conductor wire 174, the antenna conductor wire element 171 is capacitively coupled to the antenna conductor wire elements 172L and 172R. In this modification, since no antenna conductor wire element is arranged at the center of the defogger region that influences the rear visibility, a good rear view can be assured.

Figure 31:
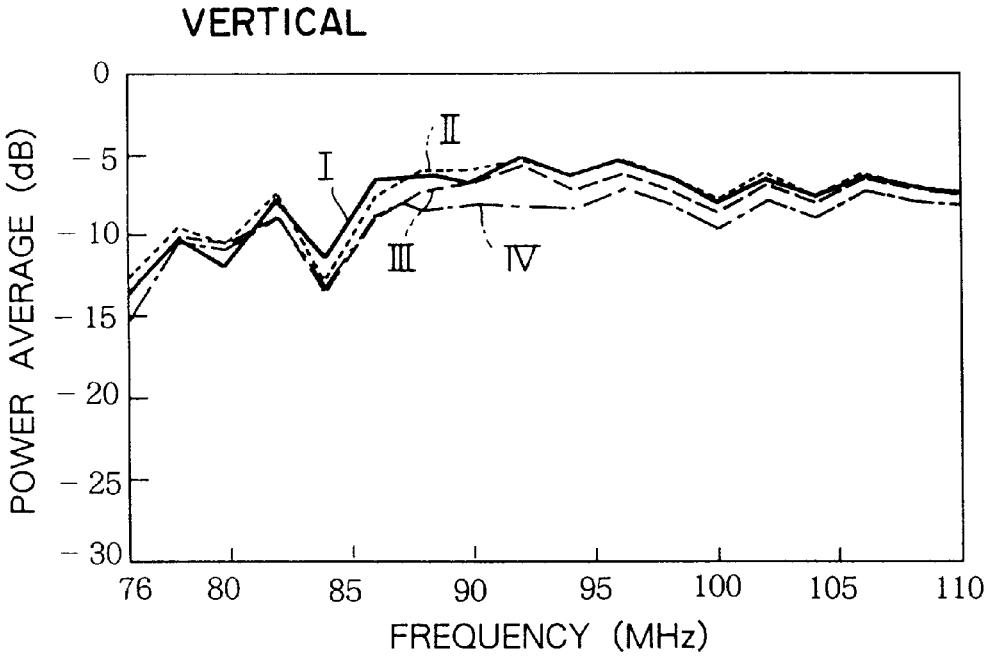
FIG. 31 is a graph showing the reception sensitivity characteristics for vertical polarized plane waves of the antenna system shown in FIG. 30.
Figure 32:
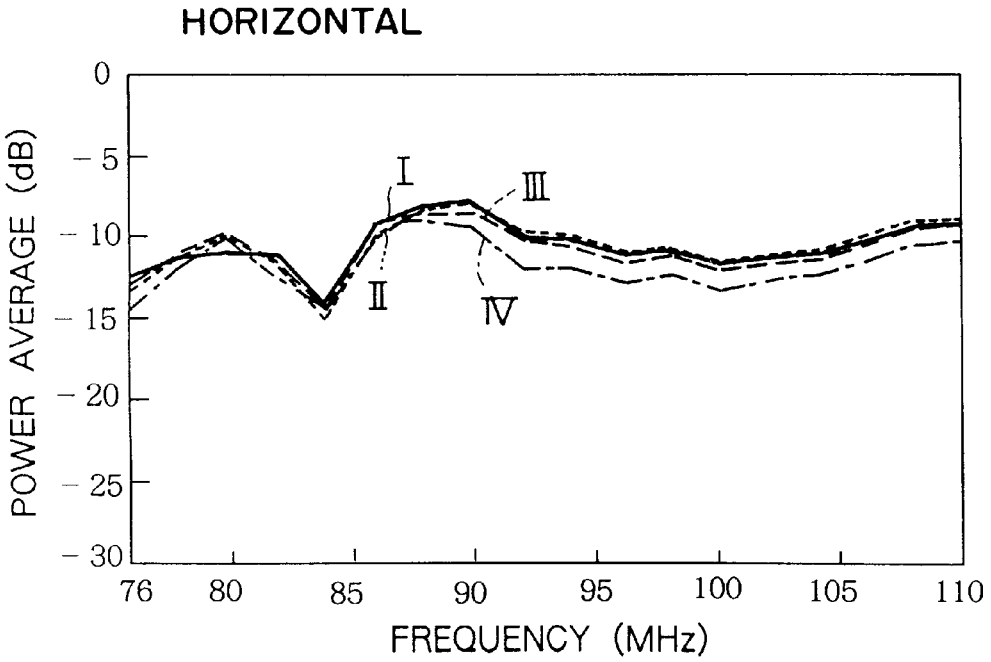
FIG. 32 is a graph showing the reception sensitivity characteristics for horizontal polarized plane waves of the antenna system shown in FIG. 30.

FIG. 31 (or FIG. 32) shows the reception strengths of the antenna conductor wire element 171 obtained when the interval between the two antenna conductor wire elements 172L and 172R in FIG. 30 is varied upon reception of vertical (or horizontal) polarized plane waves. In particular, a solid curve I represents the reception strength obtained when the antenna interval is set to be zero (the two wires are set at the central position), a broken curve II represents the reception strength obtained when the two antennas are equally separated by 10 cm from the center, a broken curve III represents the reception strength obtained when the two antennas are equally separated by 20 cm from the center, and a broken curve IV represents the reception strength obtained when the two antennas are equally separated by 30 cm from the center. As can be seen from this graph, although the reception sensitivity lowers as the two antenna conductor wire elements are separated from the center by a larger distances, a practical reception sensitivity can be obtained even when the two conductor wire elements are separated by a maximum of 30 cm.

<Improvement of Defogging Performance>

In the above-mentioned glass antenna systems shown in FIGS. 3 to 15, some elements of the antenna conductor wire elements are arranged on a region where no defogger is arranged. With this arrangement, since no hot wire extends on such a blank region, condensation occurs, and the defogging function is impaired. When the defogging function is impaired, a sufficient rear view cannot be assured.

In the fourth and fifth embodiments, an antenna conductor wire is surrounded by a hot wire of a defogger so as to minimize a region where condensation occurs, thereby assuring a sufficient defogging performance and a rear view.

Fourth Embodiment

In the fourth embodiment, one capacitive coupling antenna system is arranged at substantially the center of the glass surface.

Figure 33:
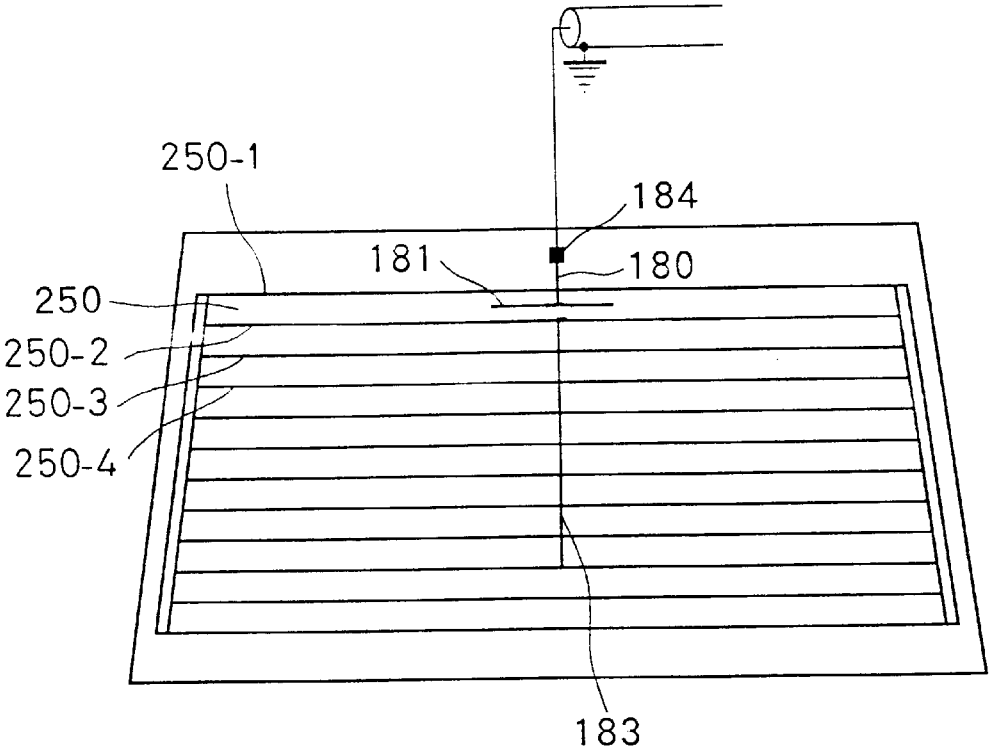
FIG. 33 is a view showing the arrangement of an antenna system according to the fourth embodiment of the present invention.

FIG. 33 shows the arrangement of an antenna system according to the fourth embodiment. Referring to FIG. 33, defogger hot wires 250 extend in a broad range that requires a sufficient rear view on the glass. In the region where the defogger hot wires 250 extend, an antenna conductor wire 183 extends vertically downward from the second uppermost hot wire 250-2 while being connected in a DC manner to the hot wires 250-3, 250-4, and the like. On the other hand, an antenna conductor wire 180 extends vertically downward from a feed point 184 and is connected to the uppermost hot wire 250-1. The antenna conductor wire 180 further extends to a position near the second uppermost hot wire 250-2, and is connected in a DC manner to a conductor wire 181 which extends in a direction parallel to the second uppermost hot wire 250-2, i.e., in the horizontal direction. Therefore, the antenna conductor wire 180 is capacitively coupled to t he antenna conductor wire 183 via a capacitor formed by the conductor wire 181 and the defogger hot wire 250-2.

In the conventional system, many elements of the antenna conductor wires must be disposed on a region outside the defogger hot wire region. However, in the fourth embodiment, most elements of the antenna conductor wires fall within the defogger region. In addition, since the defogger hot wires extend to cover the glass surface, the presence of the antenna conductor wire does not disturb the defogging performance.

The antenna system shown in FIG. 33 is designed according to equations (1) to (5) and the like, which have been described above in association with FIGS. 3 to 10. Therefore, the antenna sys t em shown in FIG. 33 is not influenced by the defogger hot wires. In other words, since no method of designing an antenna system free from the influence of the defogger hot wires is conventionally available, it is impossible to enclose antenna conductor wires within defogger hot wires. However, establishment of the method shown in FIGS. 3 to 10 allows to design the antenna system of the fourth embodiment shown in FIG. 33.

Fifth Embodiment

In the fourth embodiment, the field of view at the central portion of the glass is limited. In the fifth embodiment, two sets of antenna conductor wires are disposed at right and left positions symmetrical about the center of the glass to assure a sufficient rear view, and these antenna conductor wires are surrounded by defogger hot wires, thereby improving the defogging performance.

Figure 34:
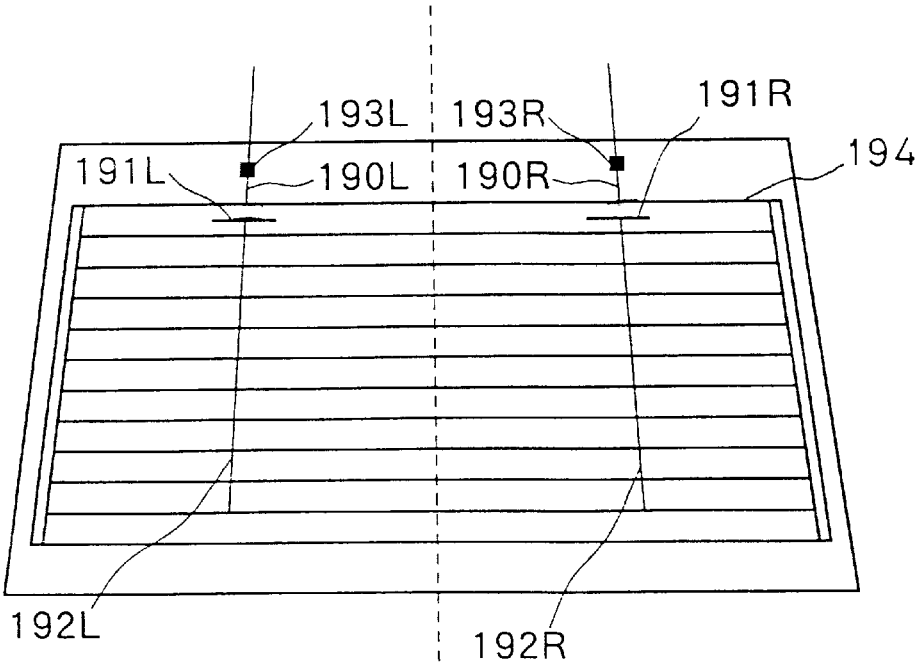
FIG. 34 is a view showing the arrangement of an antenna system according to the fifth embodiment of the present invention.

FIG. 34 shows a glass antenna system according to the fifth embodiment.

In FIG. 34, two sets of capacitively coupled antenna conductor wires (190R and 192R, and 190L and 192L) are disposed at right and left positions substantially symmetrical about the center of the glass. The antenna conductor wires 190R and 192R are capacitively coupled to each other via an uppermost hot wire 194, and the antenna conductor wires 190L and 192L are also capacitively coupled to each other via the uppermost hot wire 194. The antenna conductor wire 190L us fed from a feeding point 193L, and the conductor 190R is fed from a feeding point 193R. In accordance with the fifth embodiment, two conductor wires 191L, 191R are provided between two top hot wires including hot wire 194, although the conductor wires 191L, 191R may be located between any two adjacent hot wires. The antenna conductor wires 190L and 190R are connected to and are terminated at the upper most hot wire 194. The antenna conductor wire 192L is connected to the conductor wire 191L. Further, the antenna conductor wire 192R is connected to the conductor wire 191R. The antenna conductor wire 190L is capacitively coupled to the antenna conductor wire 192L via a capacitor formed by the conductor wire 191L and the defogger hot wire 194. Further, the antenna conductor wire 190R is capacitively coupled to the antenna conductor wire 192R via a capacitor formed by the conductor wire 191R and the defogger hot wire 194. The lengths, and the like of these sets of antenna conductor wires are determined in accordance with equations (1) to (5) above in correspondence with the wavelength band of radio waves to be received. When the defogger is divided into upper and lower regions like in the system shown in FIG. 11, equations (6) to (8) can be used.

Upon actual measurements of the characteristics of the antenna system shown in FIG. 34, substantially the same characteristics shown in FIG. 16, FIGS. 19 to 22, and FIGS. 24 to 27 are obtained. Therefore, the antenna system of the fifth embodiment not only has a good defogging performance and a sufficient rear view, but also serves as a diversity antenna system.

In the glass antenna systems of the fourth and fifth embodiments, the feed point is arranged above the defogger but may be arranged below the defogger.

<Other Modifications>

The present invention may be further modified within the spirit and scope thereof.

The glass antenna of each of the above embodiments is applied to the FM radio band and the TV VHF band as the assumed use states. Also, the glass antenna may be applied to other communication devices (e.g., a key-less entry system) using these frequency bands.

In each of the above embodiments, capacitive coupling between antenna conductor wire elements is obtained by disposing the elements on a glass surface to be separated from each other. Alternatively, a chip capacitor may be arranged between the antenna conductor wire elements to obtain capacitive coupling. Furthermore, if this chip capacitor comprises a variable capacitor whose capacitance can be varied, the coupling capacitance between the antenna conductor wire elements can be adjusted even after the window glass is attached to the vehicle body. Thus, matching to the reception frequency and fine adjustments of an optimal antenna length required due to vehicle body individual differences can be attained even for a vehicle body in a line-off state from the production line, thus obtaining remarkable effects.

As many apparently widely different embodiments of the present invention can be made without departing from the spirit and scope thereof, it is to be understood that the invention is not limited to the specific embodiments thereof except as defined in the appended claims.

What is claimed is:

1. A glass antenna arranged on a glass which has a defogger region where a plurality of hot wires extend as a defogger in a widthwise direction of a vehicle body, and a blank region where no hot wires extend, comprising:

a first antenna conductor element extending on the blank region;

a second antenna conductor element which extends in an up-and-down direction on the glass while being electrically directly connected to the hot wires of the defogger in the defogger region, capacitively coupled to said first antenna conductor element;

a third antenna conductor element which extends in the blank region at a position substantially symmetrical to said first antenna conductor element about a central line of the defogger; and a fourth antenna conductor element, which extends in the defogger region at a position substantially symmetrical to said second antenna conductor element about the central line, capacitively coupled to said third antenna conductor element;

wherein said first and third antenna conductor elements are connected to a feeding point, while said second and fourth antenna conductor elements are not connected to a feeding point.

2. The glass antenna according to claim 1, wherein said first and second antenna conductor elements serve as one antenna, said third and fourth antenna conductor elements serve as another antenna, and a coupling capacitance between said first and second antenna conductor elements and a coupling capacitance between said third and fourth antenna conductor elements are set to be not more than a predetermined value.

3. The glass antenna according to claim 1, wherein said first antenna conductor element and said third antenna conductor element have a loop shape.

4. The glass antenna according to claim 1, wherein another antenna conductor element is arranged on a blank region between said first and third antenna conductor elements.

5. The glass antenna according to claim 3, wherein another antenna conductor element is arranged on a blank region between said first and third antenna conductor elements.

6. The glass antenna according to claim 1, wherein one-end portions, in the widthwise direction of the vehicle body, of the hot wires of the defogger are connected to a first bus bar, the other end portions, in the widthwise direction of the vehicle body, of some of the hot wires of the defogger are connected to a second bus bar, and the other end portions, in the widthwise direction of the vehicle body, of the hot wires other than the some hot wires of the defogger are connected to a third bus bar.

7. A glass antenna arranged on a glass which has a defogger region where a plurality of hot wires extend as a defogger in a widthwise direction of a vehicle body, and a blank region where no hot wires extend, comprising:

a first antenna conductor element extending on the blank region;

a second antenna conductor element, which extends in an up-and-down direction in the defogger region on the glass, and which is terminated at an edge-most hot wire of the plurality of hot wires, the upper edge of the second antenna conductor element being electrically directly connected to the edge-most hot wire, the second antenna conductor element being capacitively coupled to said first antenna conductor element at the edge-most hot wire; and a third antenna conductor element, which extends in the defogger region at a position substantially symmetrical to said second antenna conductor element about a central line of the glass, and which is terminated at an edge-most hot wire of the plurality of hot wires, the upper edge of the third antenna conductor element being electrically directly connected to the edge-most hot wire, the third antenna conductor element being capacitively coupled to said first antenna conductor element at the edge-most hot wire;

wherein said first antenna conductor element is connected to a feeding point, while said second and third antenna conductor elements are not connected to a feeding point, and the first antenna conductor element is capacitively coupled with the edge-most hot wire, and the first antenna conductor element and the second antenna conductor element work as one antenna, and the first antenna conductor element and the third antenna conductor element work as one antenna.

8. The glass antenna according to claim 7, wherein said first and second antenna conductor elements work as one antenna and the first and third antenna conductor elements work as another antenna when a coupling capacitance between said first and second antenna conductor elements and a coupling capacitance between said first and third antenna conductor elements are set to be not more than a predetermined value.

9. The glass antenna according to claim 7, wherein said first antenna conductor element is disposed at a substantially center, in a horizontal direction, of the glass.

10. A glass antenna arranged on a glass on which a plurality of hot wires extend as a defogger in a widthwise direction of a vehicle body, comprising:

a first antenna conductor element which is connected to a feeding point and extends therefrom in a glass region, where the defogger is arranged, in a substantially up-and-down direction while crossing at least one hot wire of the defogger, said at least one hot wire not including all the hot wires of the defogger; and a second antenna conductor element which is not connected to a feeding point, is capacitively coupled to said first antenna conductor element, and extends on a surface of the glass in substantially the up-and-down direction in a region of the defogger, said second antenna conductor element crossing hot wires of the defogger other than said at least one hot wire;

wherein said first antenna conductor element and said second antenna conductor element serve as a first antenna.

11. The glass antenna according to claim 10, wherein said first antenna conductor element and said second antenna conductor element are disposed at substantially a central position, in the widthwise direction of the vehicle body, of the defogger.

12. The glass antenna according to claim 10, wherein said second antenna conductor element is located on an extended line of said first antenna conductor element.

13. The glass antenna according to claim 11, wherein said second antenna conductor element is located on an extended line of said first antenna conductor element.

14. The glass antenna according to claim 10, wherein said first antenna conductor element forms a capacitance between first and second outermost hot wires, in the up-and-down direction, of the defogger together with said second antenna conductor element.

15. The glass antenna according to claim 11, wherein said first antenna conductor element forms a capacitance between first and second outermost hot wires, in the up-and-down direction, of the defogger together with said second antenna conductor element.

16. The glass antenna according to claim 12, wherein said first antenna conductor element forms a capacitance between first and second outermost hot wires, in the up-and-down direction, of the defogger together with said second antenna conductor element.

17. The glass antenna according to claim 10, wherein said first antenna conductor element is electrically directly connected to said at least one hot wire.

18. The glass antenna according to claim 10, wherein said second antenna conductor element is electrically directly connected to said hot wires other than said at least one hot wire.

19. The glass antenna according to claim 17, wherein said second antenna conductor element is electrically directly connected to said hot wires other than said at least one hot wire.

20. The glass antenna according to claim 10, wherein said at least one hot wire is one hot wire located the most closely to the feeding point for the first antenna conductor element.

21. The glass antenna according to claim 10, wherein said first and second antenna conductor elements are capacitively coupled with each other in the region where the defogger is arranged on the glass.

22. The glass antenna according to claim 10, wherein said second antenna conductor element extends in a direction in which said first antenna conductor element longitudinally extends, and has a first terminal end which is remote from a distal end of said first antenna conductor element with respect to the feeding point for the first antenna conductor element.

23. The glass antenna according to claim 10, wherein either one of said first and second antenna conductor elements terminates on a hot wire and the other conductor element terminates between adjacent hot wires, the other conductor element has a conductor wire electrically directly connected thereto, said conductor wire being arranged substantially parallel to the adjacent hot wires, wherein said first and second antenna conductor elements are capacitively coupled with each other through one of the adjacent hot wires and said conductor wire.

24. A glass antenna arranged on a glass on which a plurality of hot wires extend as a defogger in a widthwise direction of a vehicle body, comprising:

a first antenna conductor element connected to a feeding point and extending in a glass region, where the defogger is arranged, in a substantially up-and-down direction while crossing at least one of the hot wires of the defogger, said at least one of the hot wires being arranged;

a second antenna conductor element, which is not connected to a feeding point, and is capacitively coupled to said first antenna conductor element, and extends on a surface of the glass in substantially the up-and-down direction in a region of the defogger:

a third antenna conductor element which crosses at least one of the hot wires of the defogger and extends in the region of the defogger in substantially the up-and-down direction; and a fourth antenna conductor element which is capacitively coupled to said third antenna conductor element, and extends on the glass surface in substantially the up-and-down direction in the region of the defogger;

wherein said first antenna conductor element and said second antenna conductor element serve as a first antenna; and said first antenna conductor element is disposed at a position substantially symmetrical to said third antenna conductor element about a central line, in the widthwise direction of the vehicle body, of the defogger, said second antenna conductor element is disposed at a position substantially symmetrical to said fourth antenna conductor element about the central line, said third antenna conductor element and said fourth antenna conductor element serve as a second antenna, and said first and second antennas constitute a diversity antenna system.

25. The glass antenna according to claim 24, wherein said second antenna conductor element is located on an extended line of said first antenna conductor element.

26. The glass antenna according to claim 24, wherein said fourth antenna conductor element is located on an extended line of said third antenna conductor element.

27. The glass antenna according to claim 24, wherein one end of said third antenna conductor element forms a capacitance between first and second outermost hot wires, in the up-and-down direction, of the defogger together with said fourth antenna conductor element.

28. The glass antenna according to claim 25, wherein one end of said third antenna conductor element forms a capacitance between first and second outermost hot wires, in the up-and-down direction, of the defogger together with said fourth antenna conductor element.

* * * * *

UNITED STATES PATENT AND TRADEMARK OFFICE

CERTIFICATE OF CORRECTION

PATENT NO.: 5,952,977
DATED : September 14, 1999
INVENTOR(S): Tatsuaki Taniguchi, et al.

It is certified that error appears in the above-identified patent and that said Letters Patent is hereby corrected as shown below:

Column 5, line 16, change "a" to --α--;

Column 8, line 50, change "a" to --α--;

Column 8, line 53, change "a" to --α--;

Column 10, line 18, equation (5) after "cm" insert --≦--;

Column 12, equations (7) & (8) after "$\alpha_2$" insert ---·---;

Column 17, line 49, change "sys t em" to --system--;

Column 18, line 9, change "us" to --is--.

Signed and Sealed this

Twenty-eighth Day of March, 2000

*Attest:*

Q. TODD DICKINSON

*Attesting Officer*

*Commissioner of Patents and Trademarks*